US010953680B2

(12) United States Patent
Sekiguchi et al.

(10) Patent No.: US 10,953,680 B2
(45) Date of Patent: Mar. 23, 2021

(54) LIQUID DISCHARGE APPARATUS

(71) Applicants: Satoyuki Sekiguchi, Kanagawa (JP); Toshiyuki Kobashi, Kanagawa (JP); Taku Hatakeyama, Kanagawa (JP); Takashi Watanabe, Kanagawa (JP)

(72) Inventors: Satoyuki Sekiguchi, Kanagawa (JP); Toshiyuki Kobashi, Kanagawa (JP); Taku Hatakeyama, Kanagawa (JP); Takashi Watanabe, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/577,483

(22) Filed: Sep. 20, 2019

(65) Prior Publication Data

US 2020/0101782 A1 Apr. 2, 2020

(30) Foreign Application Priority Data

Sep. 27, 2018 (JP) ..... JP2018-182417

(51) Int. Cl.
*B41M 5/00* (2006.01)
*B41J 11/00* (2006.01)

(52) U.S. Cl.
CPC ..... *B41M 5/0017* (2013.01); *B41J 11/002* (2013.01)

(58) Field of Classification Search
CPC .. B41M 5/0017; B41J 11/002; B41J 11/0015; B41J 2/14048
See application file for complete search history.

(56) References Cited

U.S. PATENT DOCUMENTS 5,043,741 A * 8/1991 Spehrley, Jr. ..... B41J 2/17593 347/88
2015/0103116 A1* 4/2015 Gotou ..... C09D 11/322 347/21
2018/0065379 A1* 3/2018 Ohnishi ..... D06P 5/30

FOREIGN PATENT DOCUMENTS

JP 2012-007148 1/2012
JP 2015-131419 7/2015

OTHER PUBLICATIONS

IP.com search (Year: 2020).*
U.S. Appl. No. 16/355,754, filed Mar. 17, 2019, Satoyuki Sekiguchi, et al.
U.S. Appl. No. 16/355,760, filed Mar. 17, 2019, Toshiyuki Kobashi, et al.

* cited by examiner

*Primary Examiner* — Lisa Solomon
(74) *Attorney, Agent, or Firm* — Oblon, McClelland, Maier & Neustadt, L.L.P.

(57) ABSTRACT

A liquid discharge apparatus includes a head configured to discharge a pretreatment liquid from nozzles formed on a nozzle surface of the head onto a medium, a holder configured to hold the medium with a gap between the nozzle surface of the head and the holder, and a heater configured to heat the medium held by the holder. The head discharges the pretreatment liquid onto the medium held by the holder with the gap of 4.0 mm or more.

16 Claims, 16 Drawing Sheets

LIQUID DISCHARGE APPARATUS

CROSS-REFERENCE TO RELATED APPLICATION

This patent application is based on and claims priority pursuant to 35 U.S.C. § 119(a) to Japanese Patent Application No. 2018-182417, filed on Sep. 27, 2018 in the Japan Patent Office, the entire disclosure of which is hereby incorporated by reference herein.

BACKGROUND

Technical Field

Aspects of the present disclosure relate to a liquid discharge apparatus.

Related Art

Inkjet printers have advantages such as low noise, low running cost, and easy color printing, and are widely used in general households as digital-signal output devices.

Recently, a demand for image quality equivalent to the image quality of conventional analog printing has been increased not only for home use but also for impermeable media such as coated paper, non-absorbable media such as plastic film, and fabrics such as woven fabrics and knitted fabrics by an inkjet recording method.

For example, a demand for variable printing is increased along with the rapid advancement of small lots and diversification of types of print jobs in the flexible packaging field. Thus, there is a demand for an inkjet recording system compatible with polyolefin, polyester, polyamide, and other soft packaging films.

Further, a market size in a so-called DTG (Direct to Garment) field, which directly prints on clothing such as T-shirts, increases year by year. Recently, not only a demand for conventional cotton, and cotton polyester blended media, but also a demand for sportswear rapidly increases. Thus, compatibility for polyester media is required. Such a trend is recognized not only in the DTG field but also in the entire textile field. There is a growing demand for the inkjet recording systems that can form images with excellent color development and fastness on fabrics made of various materials such as cotton and polyester even in inkjet printers with unwinding and winding mechanisms.

Water-based inks are actively developed from the viewpoint of low Volatile Organic Compounds (VOC) and safety for such coated paper, plastic film, and fabric inks.

SUMMARY

In an aspect of this disclosure, a liquid discharge apparatus includes a head configured to discharge a pretreatment liquid from nozzles formed on a nozzle surface of the head onto a medium, a holder configured to hold the medium with a gap between the nozzle surface of the head and the holder, and a heater configured to heat the medium held by the holder. The head discharges the pretreatment liquid onto the medium held by the holder with the gap of 4.0 mm or more.

In another aspect of this disclosure, the liquid discharge apparatus includes a first head configured to discharge a pretreatment liquid from first nozzles formed on a first nozzle surface of the first head onto a medium, a second head configured to discharge an ink from second nozzles formed on a second nozzle surface of the second head onto the medium, a holder configured to hold the medium with a first gap between the first nozzle surface of the first head and the holder and with a second gap between the second nozzle surface of the second head and the holder, and a heater configured to heat the medium held by the holder. The first gap is larger than the second gap.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
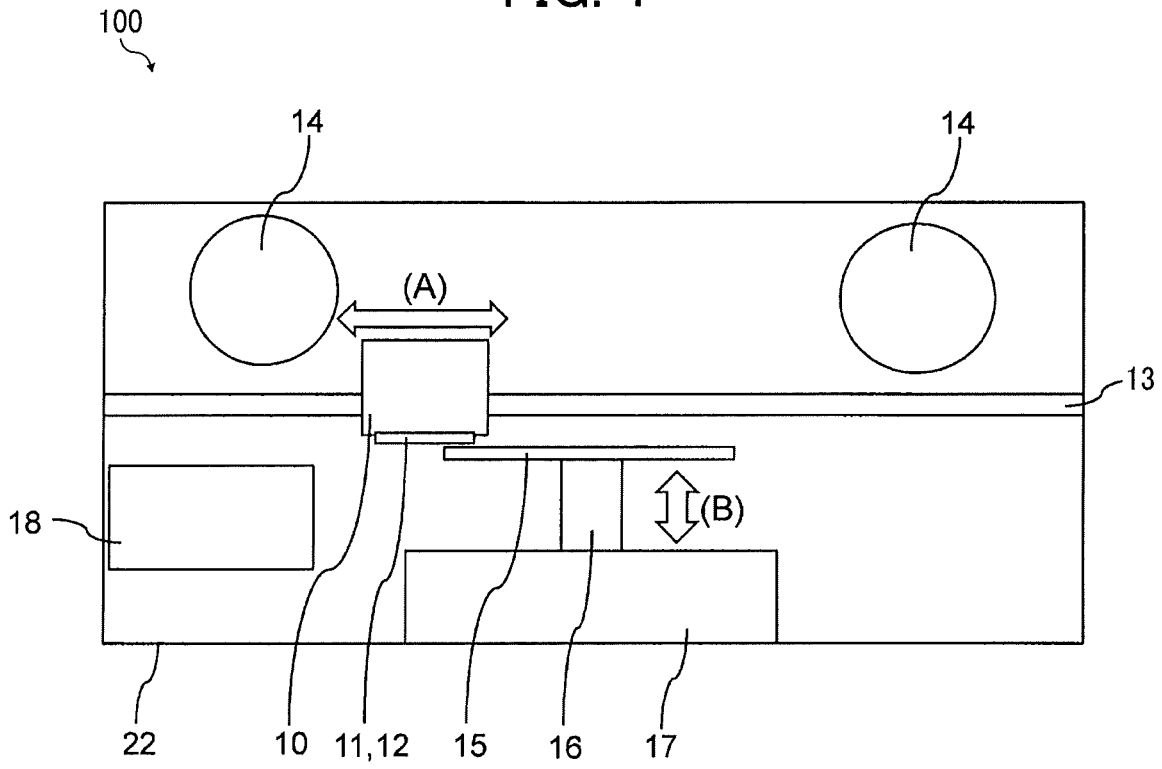
FIG. 1 is a schematic cross-sectional view (front view) of a liquid discharge apparatus in a main scanning direction (A) perpendicular to a medium conveyance direction (sub-scanning direction) according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in an analogous manner, and achieve similar results.

Although the embodiments are described with technical limitations with reference to the attached drawings, such description is not intended to limit the scope of the disclosure and all the components or elements described in the embodiments of this disclosure are not necessarily indispensable. As used herein, the singular forms "a", "an", and "the" are intended to include the plural forms as well, unless the context clearly indicates otherwise.

A liquid discharge apparatus 100 according to the present disclosure is described below with reference to the drawings. Note that the present disclosure is not limited to the following embodiments and may be other embodiments. The following embodiments may be modified by, e.g., addition, modification, or omission within the scope that would be obvious to one skilled in the art. Any aspects having advantages as described for the following embodiments according to the present disclosure are included within the scope of the present disclosure.

Figure 7:
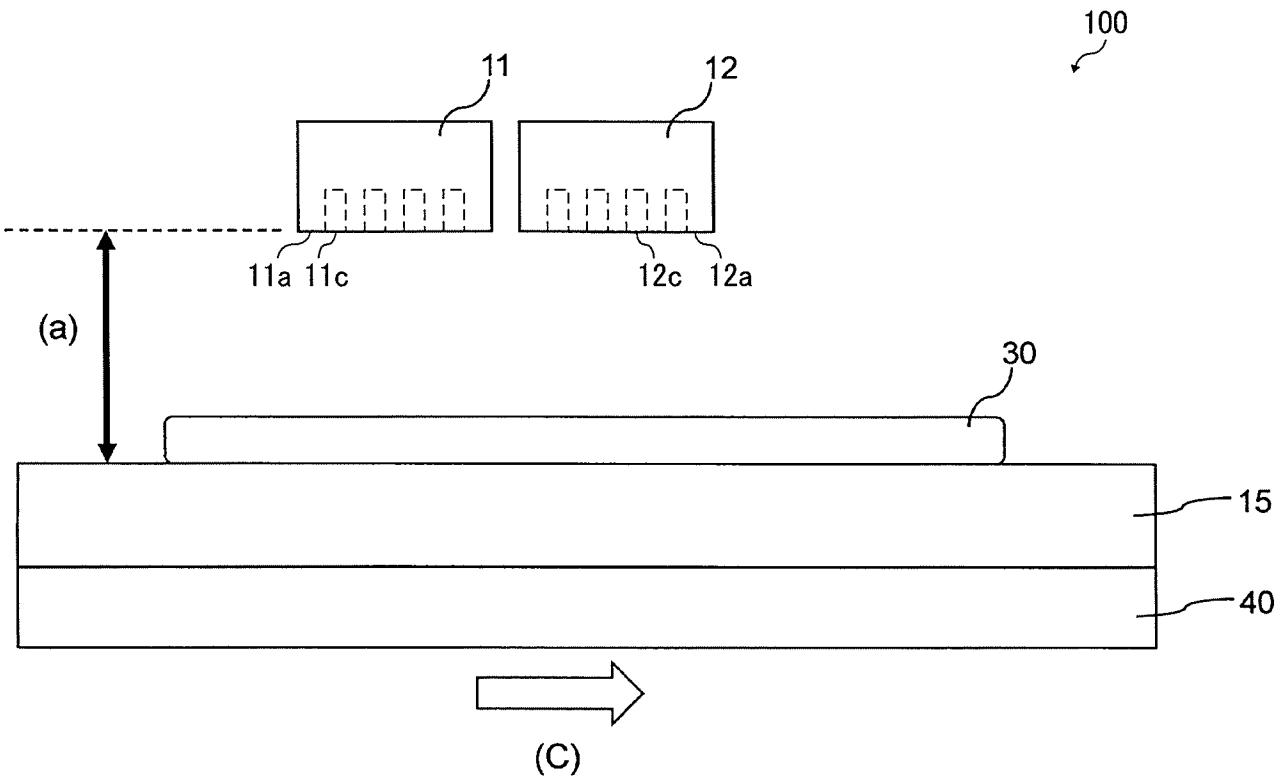
FIG. 7 is an enlarged schematic side view of a portion of the liquid discharge apparatus according to the first embodiment.

A liquid discharge apparatus 100 according to the present disclosure includes a first head 11 that discharges a pretreatment liquid from nozzles 11*c*, a platen 15 (holder) that holds a recording medium 30, and a heater 40 that heats the recording medium 30 (see FIG. 7). The first head 11 discharges the pretreatment liquid in a state in which a distance (a) between a nozzle surface 11*a* of the first head 11 and the platen 15 (holder) is 4.0 mm or more (see FIG. 7). The nozzles 11*c* are formed on the surface of the first head 11 (see FIG. 7).

The liquid discharge apparatus 100 according to the present disclosure has good discharge reliability and can form an image with less bleeding on coated paper, plastic film, and fabric.

A first embodiment of the liquid discharge apparatus 100 according to the present disclosure is described below. FIG. 1 is a cross-sectional front view of the liquid discharge apparatus 100 according to the present disclosure. In FIG. 1, the recording medium 30 is conveyed in a depth direction (or a front direction) that is a direction penetrating the paper on which FIG. 1 is drawn. A direction of conveyance of the recording medium 30 is indicated by arrow (C) in FIG. 3.

The "direction of conveyance of the recording medium 30" is also referred to as "a medium conveyance direction" or "sub-scanning direction". Thus, FIG. 1 is a schematic cross-sectional view in a direction perpendicular to the medium conveyance direction (sub-scanning direction). The direction perpendicular to the medium conveyance direction (sub-scanning direction) is also referred to as a "main scanning direction" indicated by arrow "(A)" in FIG. 1.

As illustrated in FIG. 1, the liquid discharge apparatus 100 includes a carriage 10, a first head 11, a second head 12, a carriage scanning rail 13, exhausts 14, a platen (holder), a support 16, a platen moving table 17, and a maintenance unit 18.

The platen 15 holds a recording medium 30, and the size and the like of the platen 15 can be appropriately changed.

A types of the recording medium 30 is not particularly limited, and examples thereof include coated paper, plastic film, fabric, and the like, and other examples include cloth such as T-shirts and papers.

Figure 3:
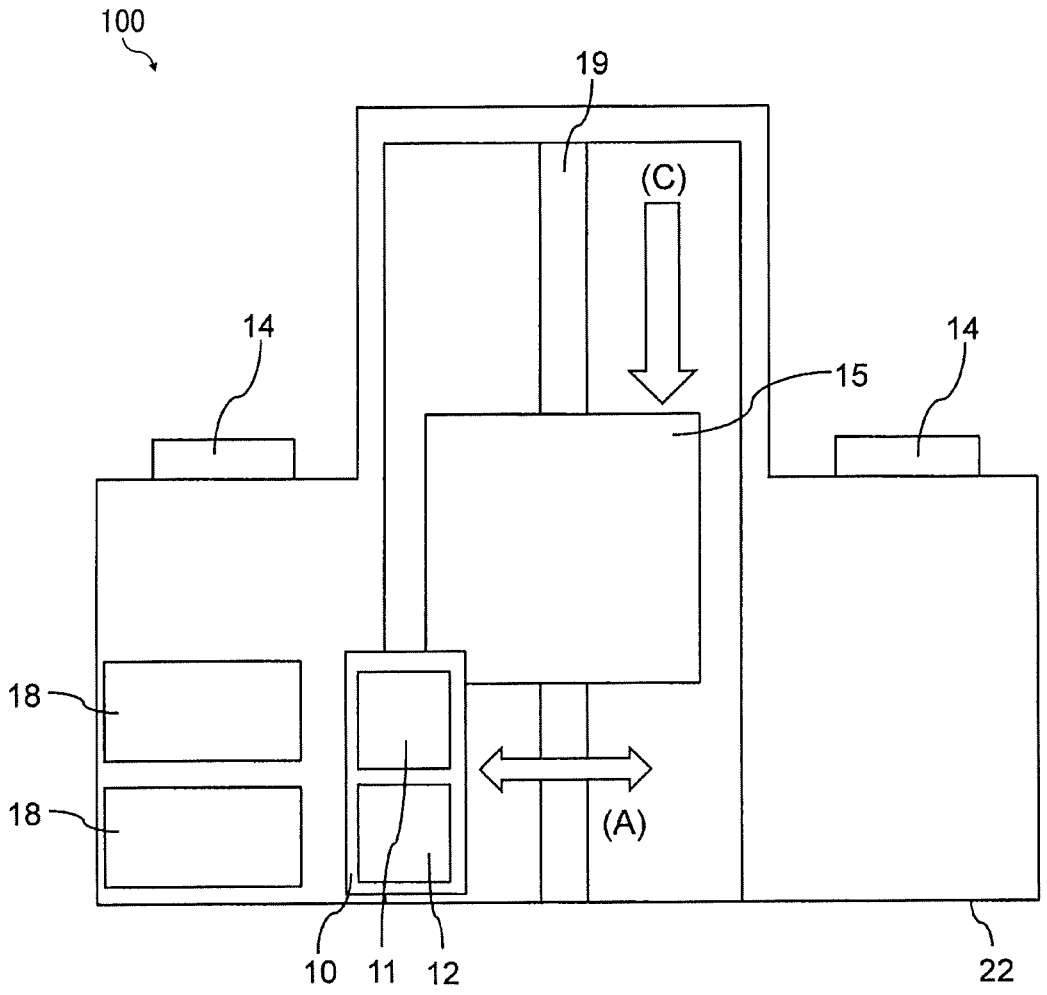
FIG. 3 is another schematic plan view of the liquid discharge apparatus according to the first embodiment.

The support 16 supports the platen 15 so that the platen 15 is movable in a vertical direction indicated by arrow (B) in FIG. 1 and in the sub-scanning direction (C) in FIG. 3.

The platen moving table 17 moves the platen 15 in the vertical direction indicated by arrow (B) and in the medium conveyance direction (main scanning direction) indicated by arrow (A) in FIG. 1.

The maintenance unit 18 maintains the first head 11 and the second head 12, and includes a cap, a suction pump, a dummy discharge receptacle, and the like.

The carriage 10 is a housing movable in the main scanning direction (A). The first head 11 and a second head 12 are mounted on the carriage 10. In addition to the heads 11 and 12, an encoder sensor, a moving belt, an elevation mechanism and the like are also attached to the carriage 10.

The carriage scanning rail 13 is a rail to guide the carriage 10 to move in the main scanning direction (A) perpendicular to the sub-scanning direction (C) in FIGS. 1 and 3.

A direction perpendicular to the medium conveyance direction of the recording medium 30 is also referred to as the main scanning direction indicated by arrow (A) in FIG. 1. The medium conveyance direction is also referred to as the sub-scanning direction (C), and the main scanning direction (A) and the sub-scanning direction (C) are orthogonal to each other.

The first head 11 discharges a pretreatment liquid, and the second head 12 discharges ink, for example. Further, the first head 11 is disposed upstream of the second head 12 in the sub-scanning direction (C) in FIG. 2. When the first head 11 and the second head 12 are described without distinction, the first head 11 and the second head 12 may be simply referred to as "heads 11 and 12".

The exhausts 14 exhaust gas in a housing 22 (apparatus body) out of the housing 22 of the liquid discharge apparatus 100. For example, the exhausts 14 may include a fan. Specifically, the exhausts 14 may include a fan connected to the motor, for example.

Figure 2:
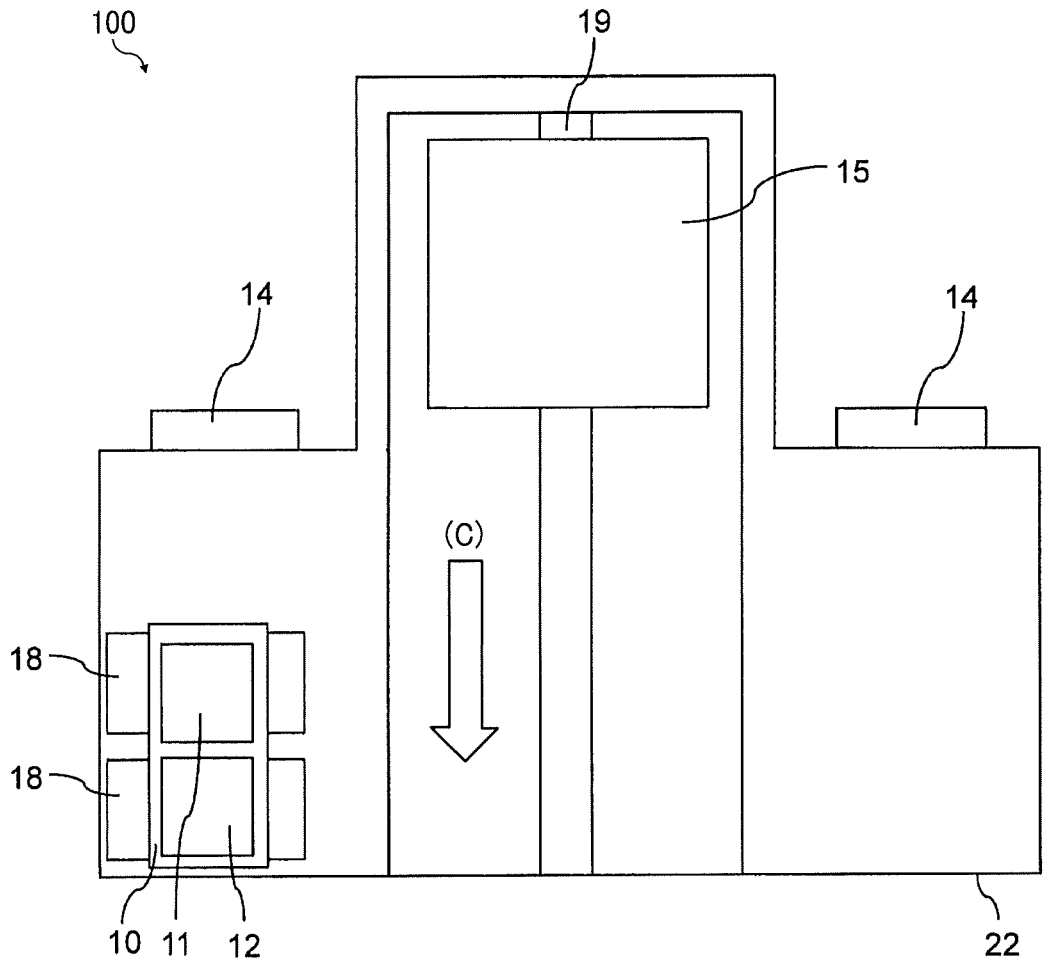
FIG. 2 is a schematic plan view of the liquid discharge apparatus according to the first embodiment.

FIG. 2 is a schematic plan view of the liquid discharge apparatus 100 according to the present disclosure. In FIG. 2, the liquid discharge apparatus 100 is in a state before the carriage 10 and the platen 15 move.

As in FIG. 2, the carriage 10 mounts the first head 11 and the second head 12. The carriage 10 moves along the carriage scanning rail 13 in the main scanning direction (A) in FIG. 1. The platen 15 moves along the platen moving rail 19 in the sub-scanning direction (C) in FIG. 2.

FIG. 3 is another schematic plan view of the liquid discharge apparatus 100 according to the present disclosure. In FIG. 3, the liquid discharge apparatus 100 is in a state during the carriage 10 and the platen 15 move.

As illustrated in FIG. 3, the platen 15 moves along the platen moving rail 19 in the sub-scanning direction (C). Since the recording medium 30 moves while being held on the platen 15, the moving direction of the platen 15 coincides with a conveyance direction of the recording medium 30 (medium conveyance direction or sub-scanning direction (C)).

As illustrated in FIG. 3, the second head 12 is disposed downstream of the first head 11 in the sub-scanning direction (C).

The platen 15 moves in the sub-scanning direction (C), and the heads 11 and 12 discharge the liquid while the carriage 10 scans in the main scanning direction (A) when the platen 15 moves near the carriage 10 in the sub-scanning direction (C). When the heads 11 and 12 discharge the liquid, the first head 11 discharges the pretreatment liquid first toward the recording medium 30, and then the second head 12 discharges ink toward the recording medium 30.

Figure 4:
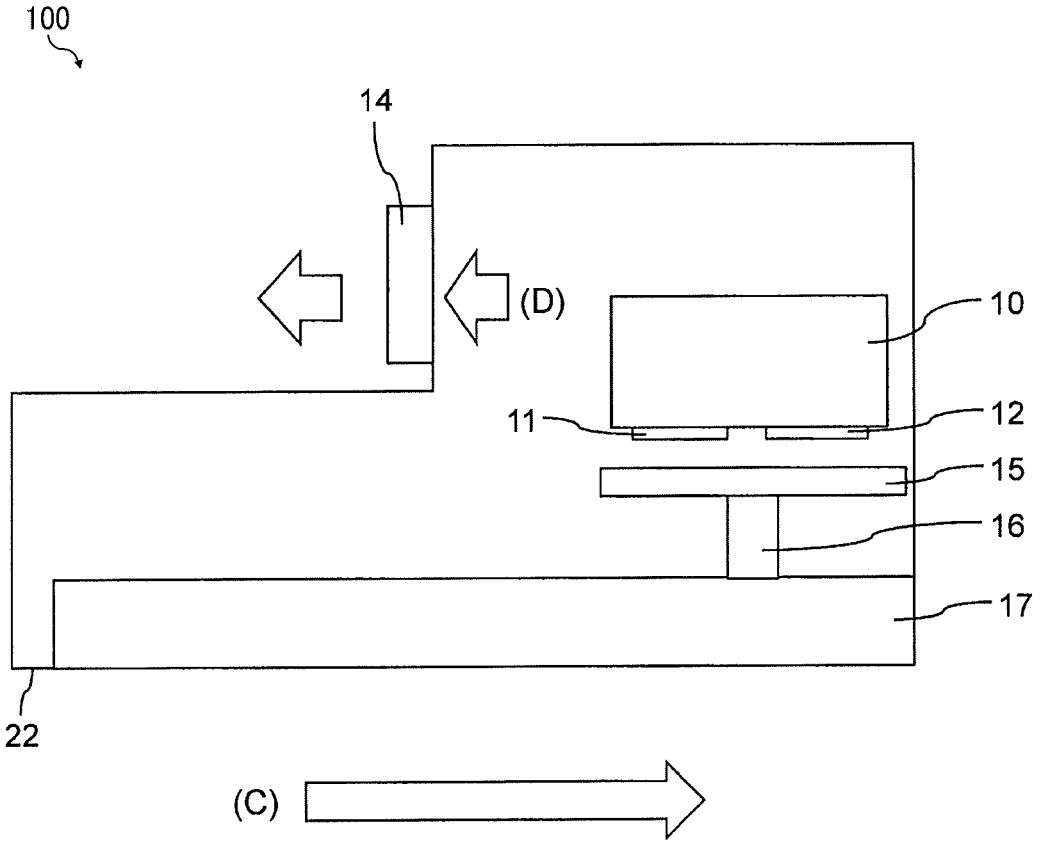
FIG. 4 is a schematic side view of the liquid discharge apparatus according to the first embodiment.
Figure 5:
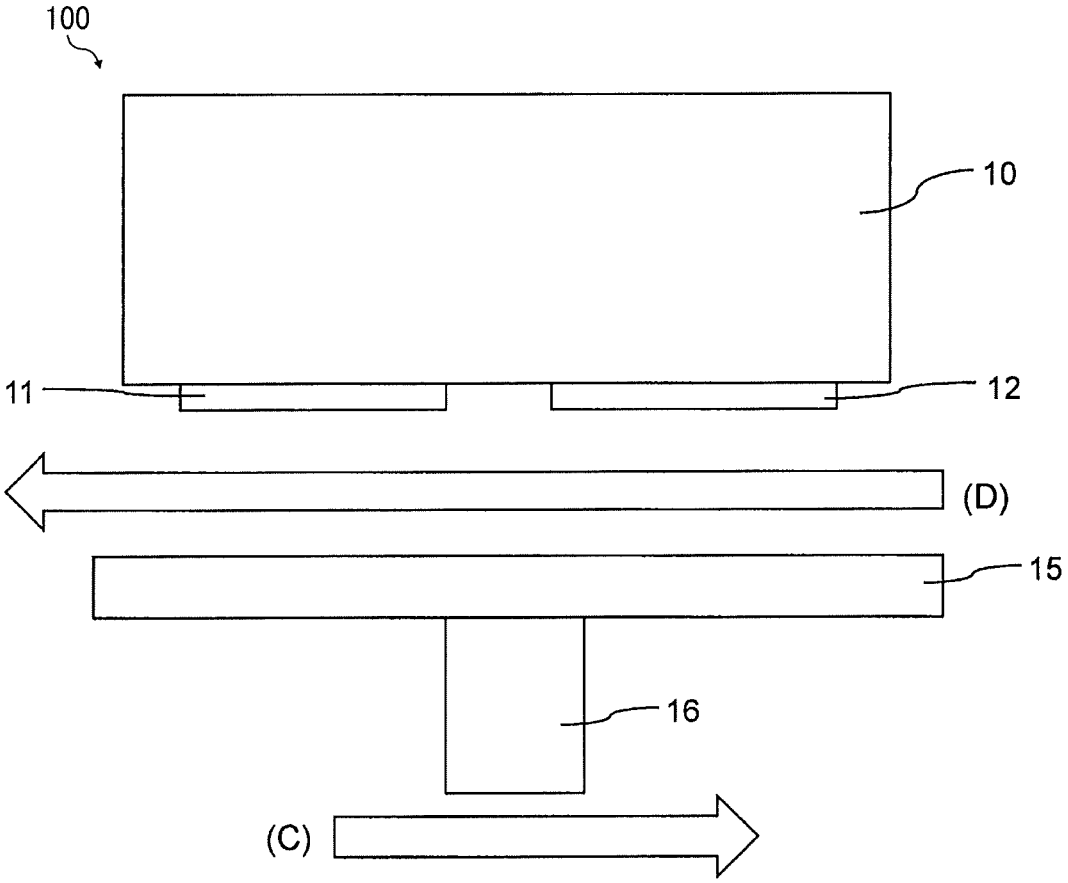
FIG. 5 is enlarged schematic side view of a portion of the liquid discharge apparatus according to the first embodiment.

FIG. 4 is a schematic side view of the liquid discharge apparatus 100 according to the present disclosure. FIG. 5 is an enlarged schematic view of a portion of the liquid discharge apparatus 100 in FIG. 4.

The exhaust 14 of the present disclosure is preferably arranged so that the gas existed between the first head 11 and the platen 15 (or the recording medium 30) flows upstream in the sub-scanning direction (C) indicated by arrow (D) in FIG. 4. Further, as indicated by arrow (D) in FIG. 4, the gas inside the housing 22 is discharged outside the housing through the exhaust 14.

Thus, a direction of flow of the gas existed between the platen 15 and each of the heads 11 and 12 is directed from the second head 12 toward the first head 11 as indicated by arrow (D) in FIG. 5. The gas flows leftward as indicated by arrow (D) in FIG. 5. Hereinafter, the direction of flow of gas indicated by arrow (D) is also referred to as a "gas flow direction (D)". In other words, the gas existed between the first head 11 and the platen 15 (or the recording medium 30) flows upstream (left in FIG. 5) in the sub-scanning direction (C).

Thus, mist of the pretreatment liquid generated in the vicinity of the first head 11 does not easily reach the second head 12. Thus, the liquid discharge apparatus 100 can prevent the mist of the pretreatment liquid to adhere to a nozzle surface 12*a* (see FIG. 7) of the second head 12 and aggregates the ink on the nozzle surface 12*a* of the second head 12. Further, the liquid discharge apparatus 100 can prevent aggregation of the ink to improve discharge reliability of the heads 11 and 12.

As illustrated in FIG. 5, the gas existed between the second head 12 and the platen 15 (or recording medium 30) may also flow upstream (left in FIG. 5) in the sub-scanning direction (C).

Figure 6:
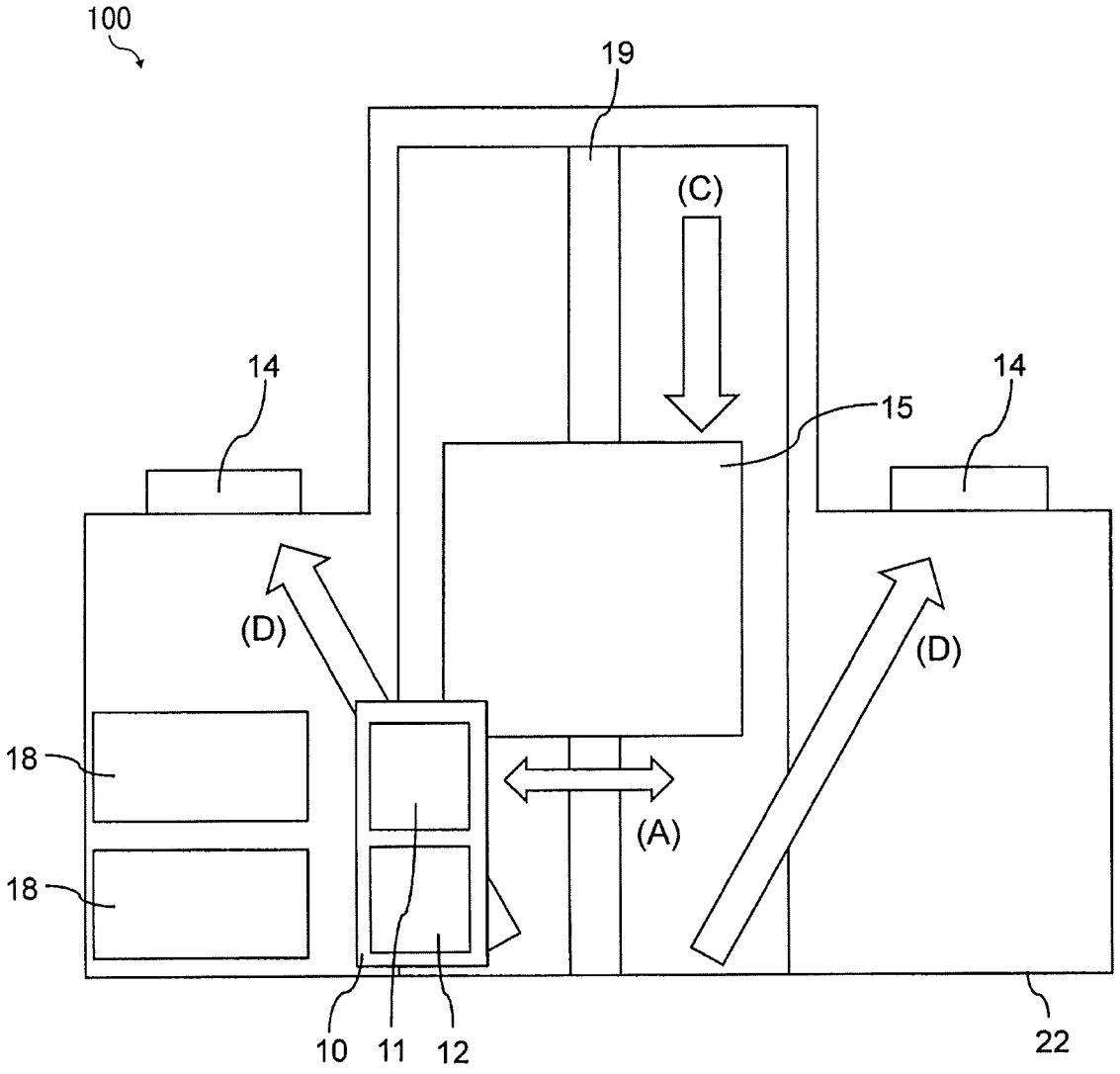
FIG. 6 is still another schematic plan view of the liquid discharge apparatus according to the first embodiment.

FIG. 6 is still another schematic plan view of the liquid discharge apparatus 100 according to the present disclosure. FIG. 6 illustrates the gas flow direction (D) in a plan view of FIG. 3.

The liquid discharge apparatus 100 according to the present disclosure includes a plurality of exhausts 14 as illustrated in FIG. 6. The plurality of exhausts 14 are all arranged upstream (upward in FIG. 6) of the first head 11 in the sub-scanning direction (C) and downstream (downward in FIG. 6) of the first head 11 in the gas flow direction (D) in FIG. 6.

Thus, the gas flow direction (D) (gas exhaust direction) is directed upstream (upward in FIG. 6) in the sub-scanning direction (C) so that the liquid discharge apparatus 100 can exert the above-described effects.

A position of the recording medium 30 may be fixed, and the carriage 10 may move upstream (upward in FIG. 6) and downstream (downward in FIG. 6) in the sub-scanning direction (C). In this case, the heads 11 and 12 may relatively move "upstream and downstream in the medium conveyance direction (sub-scanning direction)" in the present disclosure.

In other words, the "upstream side" in the medium conveyance direction (sub-scanning direction (C)) corresponds to the "downstream side" in a moving direction of the heads 11 and 12. Further, the "downstream side" in the medium conveyance direction (sub-scanning direction (C)) corresponds to the "upstream side" in a moving direction of the heads 11 and 12.

FIG. 7 is a schematic enlarged side view of a portion of the liquid discharge apparatus 100 according to the present disclosure. FIG. 7 illustrates the first head 11 that discharges the pretreatment liquid from the nozzles 11*c*, the second head 12 that discharges the ink from the nozzles 12*c*, the platen 15 (holder) that holds the recording medium 30, and the heater 40 that heats the recording medium 30.

When the liquid discharge apparatus 100 discharges the ink onto the recording medium 30 to perform printing, the liquid discharge apparatus 100 use the pretreatment liquid to increase image density of the image formed on the recording medium 30. Thus, the pretreatment liquid is frequently used in the printing to increase the image density.

However, when drying (heating) is not performed after the pretreatment, bleeding occurs at a color boundary of the image formed by the ink discharged after the application of the pretreatment liquid on the recording medium 30, particularly on a medium such as a fabric or a film.

Further, drying after the pretreatment may cause clogging of nozzles 11*c* and 12*c* because the polyvalent metal salt generally used as a flocculant in the pretreatment liquid tends to cause clogging of nozzles 11*c* and 12*c* by drying.

Precipitation due to counter ions or the like becomes significant with increase in a particle size or concentration of the polyvalent metal salt in the pretreatment liquid. Thus, non-discharge of nozzles 11*c* and 12*c* may be occurred only by heating with the heater 40, and thus the printing may not be performed.

Conversely, the first head 11 discharges the pretreatment liquid from the nozzles 11*c* onto the recording medium 30 while a distance (a) (see FIG. 7) of 4.0 mm or more is formed between the nozzle surface 11*a* of the first head 11, on which the nozzles 11*c* are formed, and a surface of the platen 15 (holder), on which the recording medium 30 is placed and held, in the present disclosure. The distance (a) is also referred to as the "gap (a)".

Thus, the liquid discharge apparatus 100 can heat the recording medium 30 onto which the pretreatment liquid has been applied while preventing vaporized solvent generated by heating the recording medium 30 from adversely affecting the nozzles 11*c* of the first head 11. The liquid discharge apparatus 100 can prevent clogging of the nozzles 11*c* of the first head 11, increase discharge reliability, and prevent bleeding of image on a printed matter.

Conversely, when the distance (a) between the nozzle surface 11*a* of the first head 11 and the platen 15 is less than 4.0 mm, the liquid discharge apparatus 100 may not increase discharge reliability and may not prevent bleeding of image on a printed matter.

The liquid discharge apparatus 100 may be any device and is not limited to the above-described apparatus as long as the apparatus can discharge the pretreatment liquid while keeping the distance (a) (gap) of 4.0 mm or more.

Further, the distance (gap) between the nozzle surface 11*a* of the first head 11 and the platen 15 (holder) is preferably 4.5 mm or more. The gap of 4.5 mm or more cab improve the discharge reliability of the first head 11.

It is not particularly limited that the upper limit of the distance (a) between the nozzle surface 11*a* of the first head 11, on which the nozzles 11*c* are formed, and the platen 15.

The heater 40 is provided on a lower surface of the platen 15 (holder) in the present disclosure as illustrated in FIG. 7. The lower surface of the platen 15 is opposite to an upper surface of the platen 15 on which the recording medium 30 is placed and held. Here, "provided" includes that the heater 40 and the platen 15 are provided as separate bodies and contacting with each other. Further, the heater 40 may be built in the platen 15. The above-described "provided" may also include the heater 40 built in the platen 15.

Since the heater 40 is provided on the platen 15, the recording medium 30 can be continuously heated before and after the application (discharge) of the pretreatment liquid from the first head 11. Thus, the heater 40 can effectively heat the recording medium 30.

Types of the heater 40 may be appropriately changed. For example, the liquid discharge apparatus 100 may include the heater 40 that irradiates heating energy from a position away from the recording medium 30.

In the present disclosure, the distance (a) (gap) between the nozzle surface 11*a* of the first head 11 and the platen 15 is along a vertical direction as in FIG. 7.

The thickness of the recording medium 30 is preferably 3.5 mm or less. When fabric is used for the recording medium 30, an accuracy of landing of the liquid discharged from the first head 11 onto the recording medium 30 may be reduced due to fluffing of the fabric.

Since a heated portion of the fabric (recording medium 30) rises and comes close to the nozzles 11*c*, the heat from the fabric may be conducted to the nozzles 11*c* and cause non-discharge of the first head 11.

Conversely, the liquid discharge apparatus 100 according to the present disclosure sets the thickness of the recording medium to 3.5 mm or less to prevent such a problem. In other words, the distance (gap) between the first head 11 and the recording medium 30 is preferably 1.5 mm or more.

The thickness of the recording medium 30 is measured excluding the fuzzy portion. Further, the thickness of the recording medium 30 is measured after a surface of the recording medium 30 is smoothed with a pressing member etc. before a measurement.

The recording medium is not particularly limited. For example, plain paper, gloss paper, special paper, and cloth can be used. Also, impermeable substrates may be used to form good quality images.

The impermeable substrate is a substrate having a surface with low water permeability and absorbency. The impermeable substrate may include a material that includes many cavities inside the material, and the cavities are not open outside the material. More quantitatively, the impermeable substrate refers to a substrate that absorbs water in an amount of 10 $mL/m^2$ or less from the start of contact to 30 $msec^{1/2}$, when measured according to the Bristow's method.

Specific preferred examples of the impermeable substrate include, but are not limited to, plastic films such as vinyl chloride resin films, polyethylene terephthalate (PET) films, polypropylene films, polyethylene films, and polycarbonate films.

The recording medium is not limited to articles used as typical recording media. Examples of articles usable as the recording medium include: building materials such as wall paper, floor material, and tile; cloth for apparel such as T-shirt; textile; and leather. A configuration of paths through which the recording medium 30 is conveyed may be adjusted so that ceramics, glass, and metals can be used as the recording medium 30.

Second Embodiment

Next, another embodiment of the liquid discharge apparatus 100 according to the present disclosure is described below.

Descriptions common to the above-described embodiment are omitted as appropriate.

Figure 8:
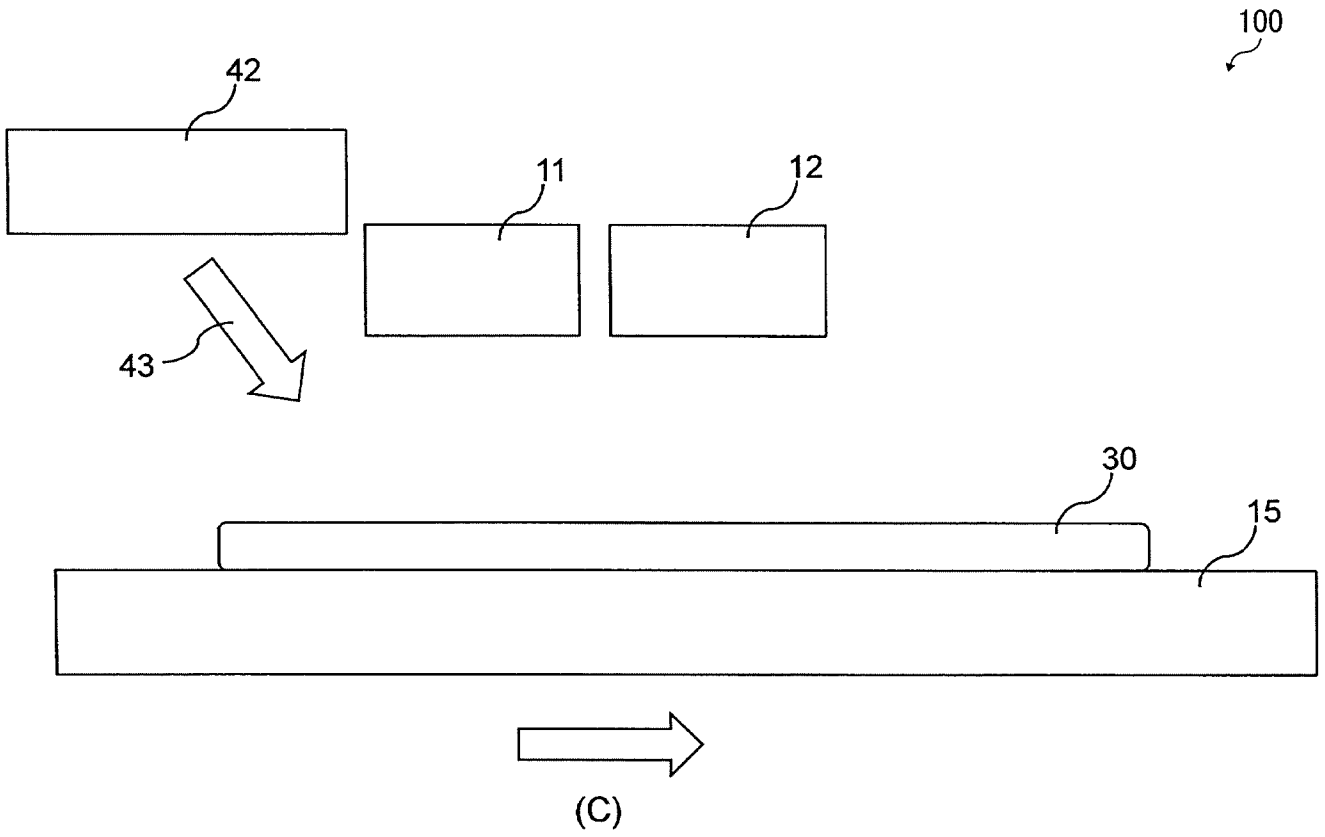
FIG. 8 is an enlarged schematic side view of a portion of the liquid discharge apparatus according to a second embodiment of the present disclosure.

FIG. 8 is a schematic side view of the liquid discharge apparatus 100 according to the present disclosure. The liquid discharge apparatus 100 in FIG. 8 is different from the above-described embodiment in a configuration of the heater 40. The liquid discharge apparatus 100 according to the present disclosure includes a hot-air applier 42 that applies the hot air 43 onto the recording medium 30. The hot-air applier 42 is disposed apart from the platen 15 (holder).

Also in the present embodiment, the first head 11 discharges the pretreatment liquid from the nozzles 11*c* onto the recording medium 30 while a distance (a) (gap) of 4.0 mm or more is formed between the nozzle surface 11*a* of the first head 11, on which the nozzles 11*c* are formed, and a surface of the platen 15 (holder), on which the recording medium 30 is placed and held.

Thus, the liquid discharge apparatus 100 can heat the recording medium 30 onto which the pretreatment liquid has been applied while preventing vaporized solvent generated by heating the recording medium 30 from adversely affecting the nozzles 11*c* of the first head 11.

Thus, the liquid discharge apparatus 100 prevents clogging of the nozzles 11*c* of the first head 11 to achieve both of an increase in the discharge reliability and a prevention of the bleeding of image on the printed matter.

Third Embodiment

Next, another embodiment of the liquid discharge apparatus 100 according to the present disclosure is described below.

Descriptions common to the above-described embodiment are omitted as appropriate.

Figure 9:
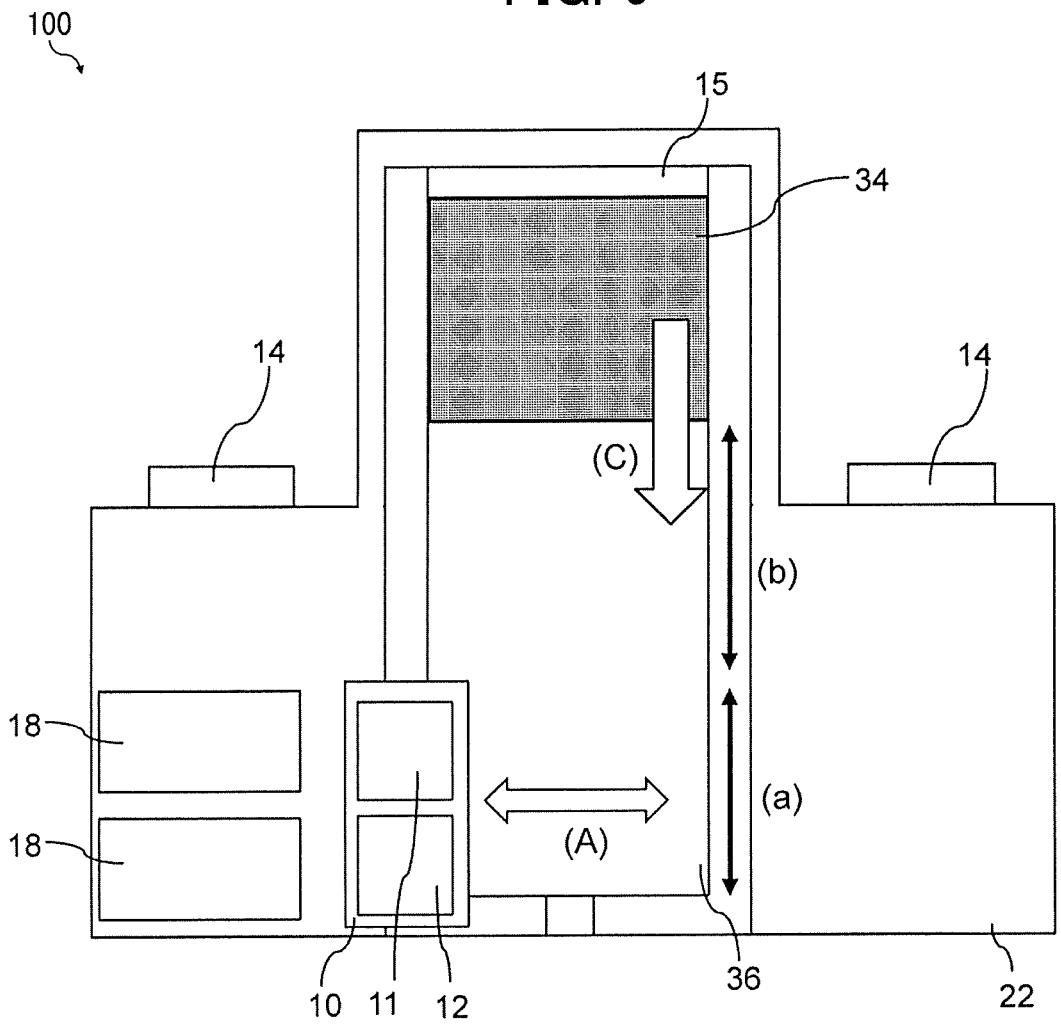
FIG. 9 is a schematic plan view of the liquid discharge apparatus according to a third embodiment of the present disclosure.

FIG. 9 is a schematic plan view of the liquid discharge apparatus 100 according to the present disclosure.

Figure 10:
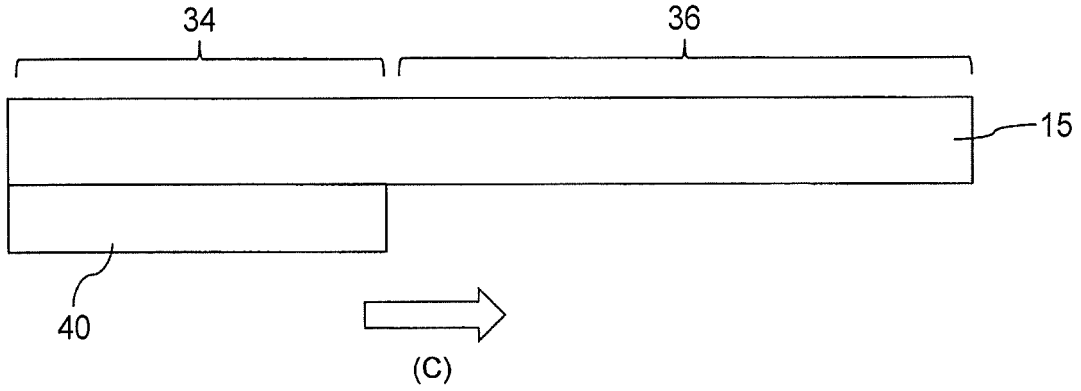
FIG. 10 is an enlarged schematic side view of a portion of the liquid discharge apparatus according to the third embodiment of the present disclosure.

FIG. 10 is an enlarged schematic side view of a portion of the liquid discharge apparatus 100 according to the present disclosure.

The platen 15 in the third embodiment includes a first holding area 34 and a second holding area 36. The first holding area 34 includes the heater 40. The second holding area 36 does not include the heater 40. The first head 11 does not discharge the pretreatment liquid at a position facing the first holding area 34.

The liquid discharge apparatus 100 in the third embodiment conveys the recording medium 30 on the platen 15. Specifically, the recording medium 30 is conveyed to a second holding area 36 after being heated in a first holding area 34. Then, the first head 11 discharges the pretreatment liquid onto the recording medium 30 in the second holding area 36.

The first head 11 does not discharge the pretreatment liquid at a position facing the first holding area 34. Thus, the first head 11 discharges the pretreatment liquid at a position facing a part of the second holding area 36 to reduce heat radiated to the first head 11 and improve the discharge reliability.

In FIG. 10, the heater 40 is disposed in contact with a part of the platen 15, that is, the first holding area 34. However, the heater 40 is not limited to the configuration as described above, and the liquid discharge apparatus 100 according to the present disclosure may include heater 40 built inside a part of the platen 15.

Figure 11:
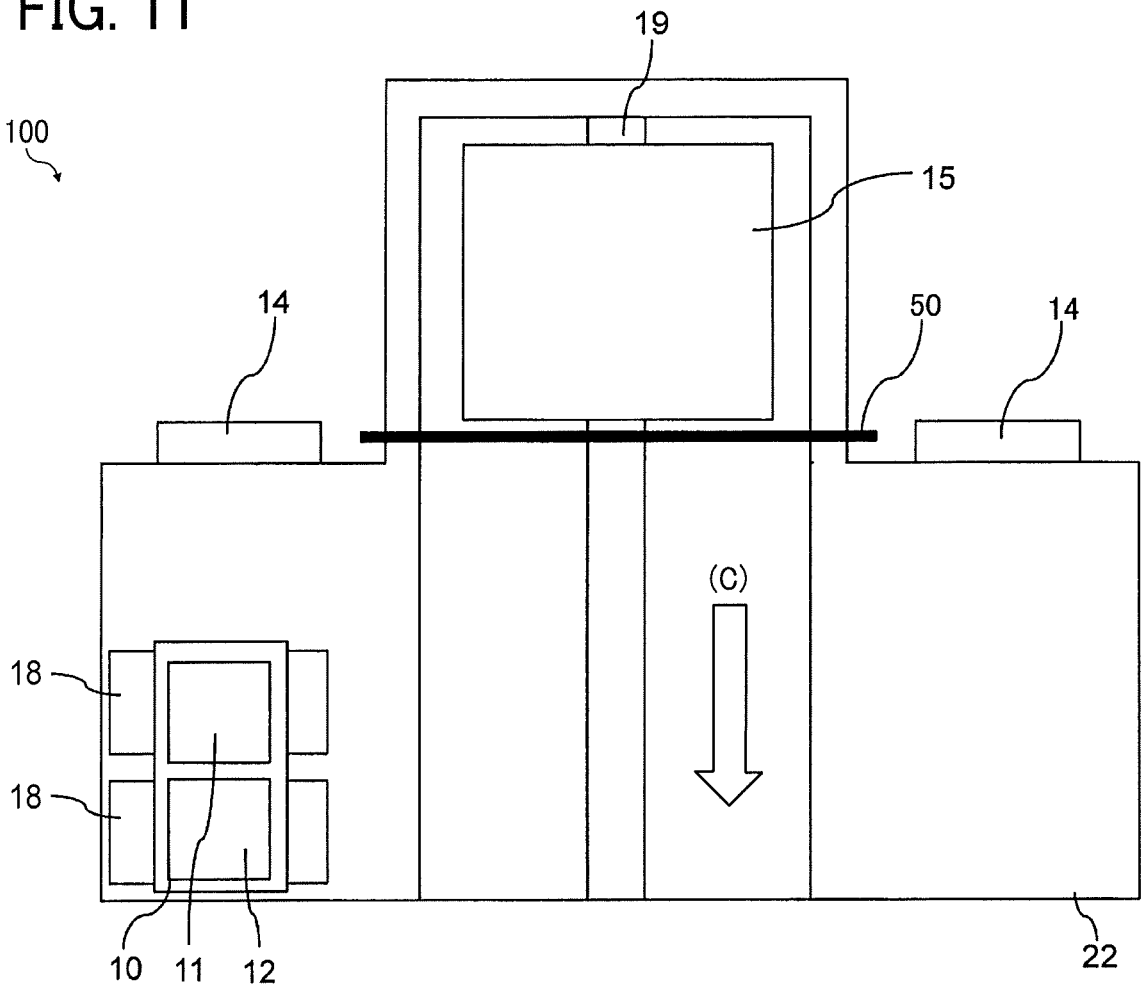
FIG. 11 is a schematic plan view of the liquid discharge apparatus according to a fourth embodiment of the present disclosure.

As illustrated in FIGS. 10 and 11, the first holding area 34 is disposed upstream of each of the second holding area 36 and the first head 11 in the sub-scanning direction (C). Thus, the heater 40 heats the recording medium 30 in the first holding area 34 before the recording medium 30 is conveyed to the second holding area 36 at which the pretreatment liquid is discharged onto the recording medium 30. Thus, the pretreatment liquid on the recording medium 30 in the second holding area 36 is heated by heat of the recording medium 30 that is previously heated in the first holding area 34.

In the third embodiment, the first holding area 34 may have a temperature gradient. Preferably, the first holding area 34 has a temperature gradient lower at the second holding area 36 side and higher at a side opposite to the second holding area 36 in the first holding area 34. That is, the first holding area 34 preferably has a higher temperature on the upstream side (left side in FIG. 10) and a lower temperature on the downstream side (right side in FIG. 10) in the sub-scanning direction (C).

Thus, the first holding area 34 has a temperature gradient in which temperature decreases toward the second holding area 36.

The platen 15 (holder) having the temperature gradient can heats the recording medium 30 first at higher temperature and then keep the temperature of the recording medium 30 at a lower temperature to further reduce an influence of the heat on the first head 11.

In the third embodiment, the second holding area 36 includes a first area (a) facing the first head 11 and a second area (b) not facing the first head 11 as illustrated in FIG. 9. The first area (a) facing the first head 11 preferably has a lower temperature than a temperature of the second area (b) not facing the first head 11.

Thus, the second holding area 36 includes the first area (a) that faces the first head, and the second area (b) that does not face the first head, and temperature at the first area (a) is lower than temperature at the second area (b).

The heat generated from the heater 40 may be transmitted from the first holding area 34 to the second holding area 36 to affect the first head 11 depending on a material of the platen 15. Conversely, the temperature in the area (a) is lower than the temperature in the area (b) in the second holding area 36 in FIG. 9 in the third embodiment. Thus, the platen 15 (holder) in the third embodiment can reduce the influence of heat from the first holding area 34 and further reduce the influence of the heat on the first head 11.

In FIG. 9, not only the area facing the first head 11 but the area facing the second head 12 are also referred to as an area facing the first head 11 in FIG. 9. The area facing the first head 11 includes an area facing the first head 11 and the second head 12 or an area facing the carriage 10.

Fourth Embodiment

Next, another embodiment of the liquid discharge apparatus 100 according to the present disclosure is described below.

Descriptions common to the above-described embodiment are omitted as appropriate.

Figure 12:
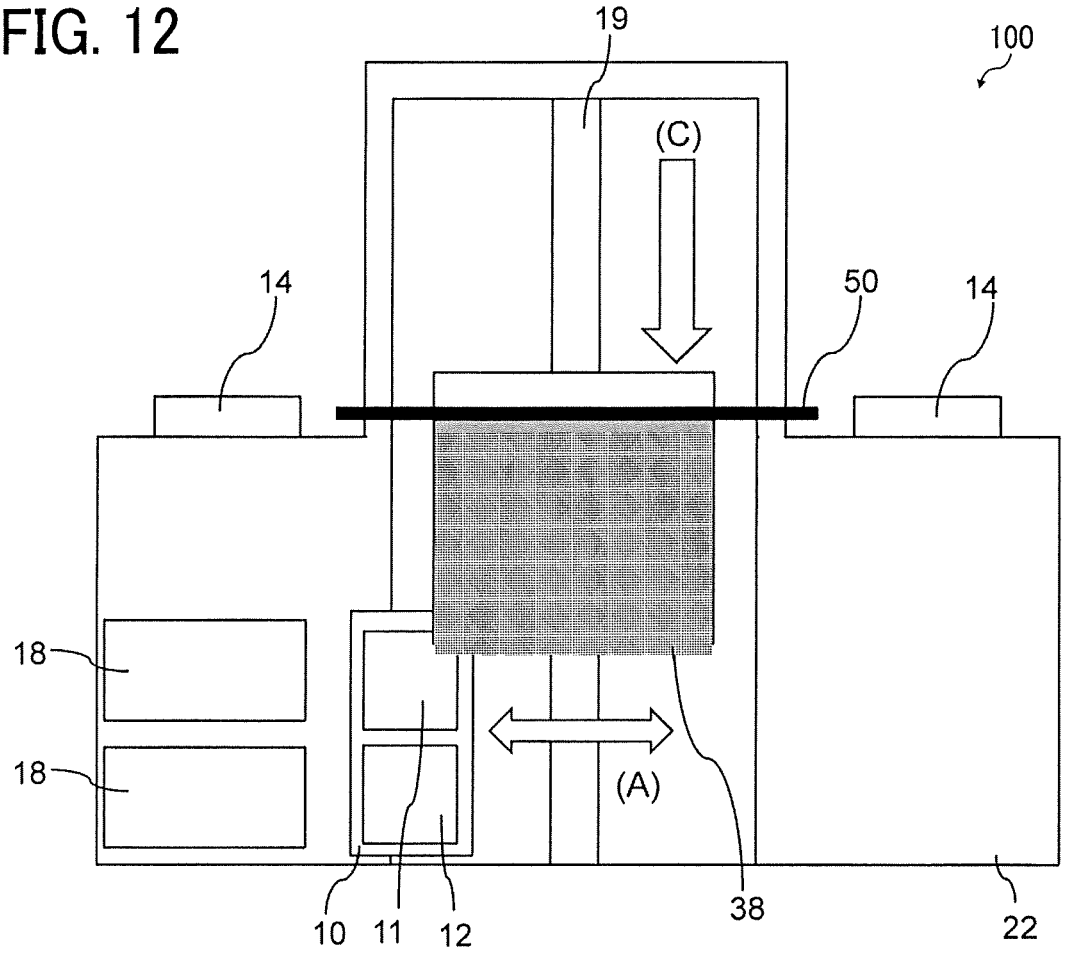
FIG. 12 is another schematic plan view of the liquid discharge apparatus according to the fourth embodiment of the present disclosure.

FIGS. 11 and 12 are schematic plan views of the liquid discharge apparatus according to the fourth embodiment of the present disclosure.

The liquid discharge apparatus 100 according to the fourth embodiment includes a pressing member 50 that presses the recording medium 30 against a part of the platen 15 (holder) before the first head 11 discharges the pretreatment liquid onto the recording medium 30.

FIG. 11 illustrates a state of the liquid discharge apparatus 100 before the recording medium 30 is pressed by the pressing member 50. FIG. 12 illustrates a state of the liquid discharge apparatus 100 during the recording medium 30 is pressed by the pressing member 50. In FIG. 12, a pressed portion 38 is a portion of the platen 15 pressed by the pressing member 50.

When fabric is used for the recording medium 30, an accuracy of landing position of the liquid discharged from the first head 11 onto the recording medium 30 may be reduced due to fluffing of the fabric. Further, a part of the recording medium 30 heated by the heater 40 rises and approaches the nozzles 11*c* by the fluffing of the fabric.

Thus, the heat from the fabric may be conducted to the nozzles 11*c* and cause non-discharge of the first head 11.

Conversely, the pressing member 50 in the fourth embodiment press the recording medium 30 from a printing surface of the recording medium 30 before the first head 11 discharges the pretreatment liquid onto the recording medium 30.

Thus, the pressing member 50 can smooth a surface of the recording medium 30 to prevent fluffing of the surface of the recording medium 30. Thus, the fourth embodiment can increase the accuracy of landing position of the liquid discharged from the first head 11 onto the recording medium 30 and also prevent non-discharge of the first head 11 due to heat conducted to the nozzles 11*c* of the first head 11.

The pressing member 50 preferably press the recording medium 30 which the heater 40 heats the recording medium 30 so that the pressing member 50 can further smooth the surface of the recording medium 30.

A configuration of the pressing member 50 is not particularly limited and can be appropriately changed. Examples of the pressing member 50 include a blade. Further, the pressing member 50 may include a press to press the recording medium 30.

A method of pressing is not particularly limited and can be appropriately changed. For example, the pressing member 50 may move toward and away from the platen 15. The platen 15 may move toward and away from the pressing member 50. Further, both of the pressing member 50 and the platen 15 may move relative to each other.

Fifth Embodiment

Next, another embodiment of the liquid discharge apparatus 100 according to a fifth embodiment of the present disclosure is described below.

Descriptions common to the above-described embodiment are omitted as appropriate.

Figure 13:
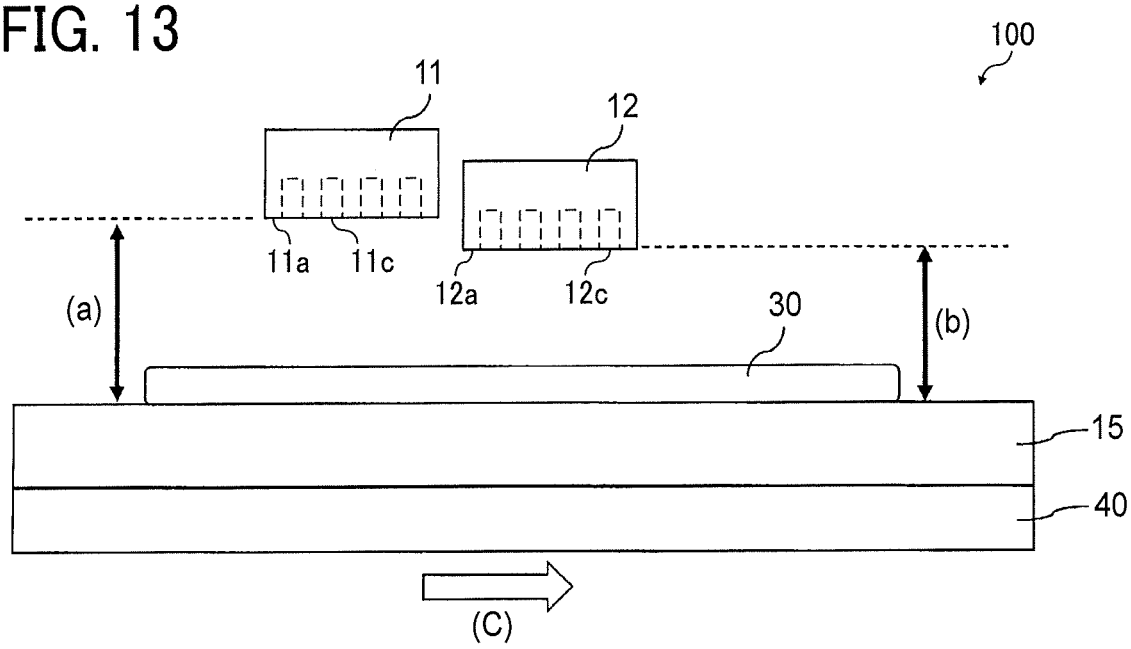
FIG. 13 is an enlarged schematic side view of a portion of the liquid discharge apparatus according to a fifth embodiment of the present disclosure.

FIG. 13 is a schematic side view of a liquid discharge apparatus 100 according to the firth embodiment.

In the liquid discharge apparatus 100 in the firth embodiment as illustrated in FIG. 13, a distance (a) (gap) between the nozzle surface 11*a* of the first head 11 and the platen 15 (holder) is made larger than a distance (b) (gap) between the nozzle surface 12*a* of the second head 12 and the platen 15 (holder). The second head 12 preferably discharges the ink onto the recording medium 30 with the distance (b) smaller than the distance (a) in FIG. 13 when the first head 11 discharges the pretreatment liquid onto the recording medium 30 with the distance (a) in FIG. 13.

The pretreatment liquid may be applied, for example, to the entire printing area of the recording medium 30, and the accuracy of landing position is not required for the pretreatment liquid.

Conversely, the ink discharged from the second head 12 preferably has a certain degree of the accuracy of landing position.

Thus, the liquid discharge apparatus 100 in the fifth embodiment reduces the distance (b) between the nozzle surface 12*a* of the second head 12 and the platen 15 to be smaller than the distance (a) between the nozzle surface 11*a* of the first head 11 and the platen 15.

Thus, the liquid discharge apparatus 100 in the fifth embodiment can increase the accuracy of landing position of the ink onto the recording medium 30. The pigment contained in the ink has a small particle size and is different from the flocculant contained in the pretreatment liquid. Thus, the influence of the heat conducted from the heater 40 (or heated recording medium 30) to the second head 12 may be small even if the distance (b) between the second head 12 and the platen 15 is reduced.

In FIG. 13, the platen 15 includes the heater 40 in the area facing the first head 11 and the second head 12. However, the fifth embodiment is not limited to the configuration as in FIG. 13, and the platen 15 may include the first holding area 34 and the second holding area 36 as in the third embodiment as illustrated in FIG. 10.

Sixth Embodiment

Next, another embodiment of the liquid discharge apparatus 100 according to a sixth embodiment of the present disclosure is described below.

Descriptions common to the above-described embodiment are omitted as appropriate.

Figure 14:
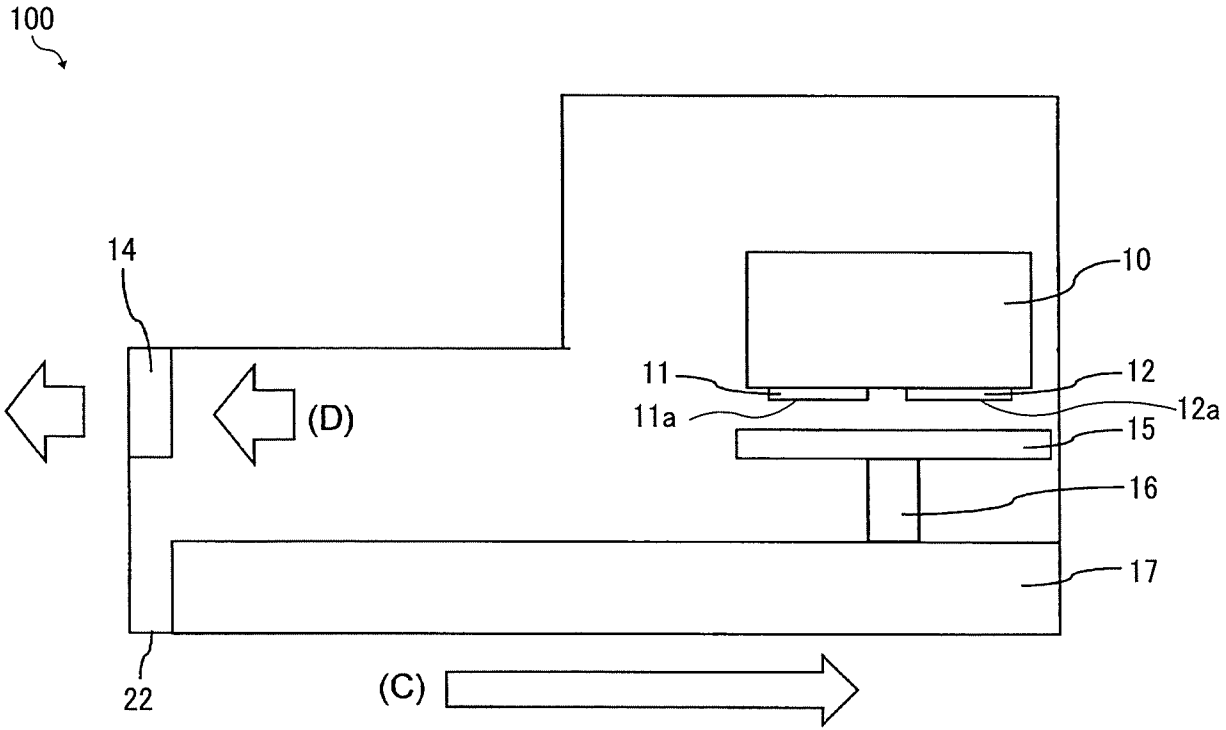
FIG. 14 is an enlarged schematic side view of the liquid discharge apparatus according to a sixth embodiment of the present disclosure.

FIG. 14 is a schematic side view of the liquid discharge apparatus 100 according to a sixth embodiment of the present disclosure. The liquid discharge apparatus 100 in FIG. 14 is different from the above-described embodiment in an arrangement of the exhaust 14.

The arrangement of the exhaust 14 is not particularly limited and may be appropriately changed. For example, the exhaust 14 may be arranged at an end part of a movement range of the platen 15 as in FIG. 14.

Figure 15:
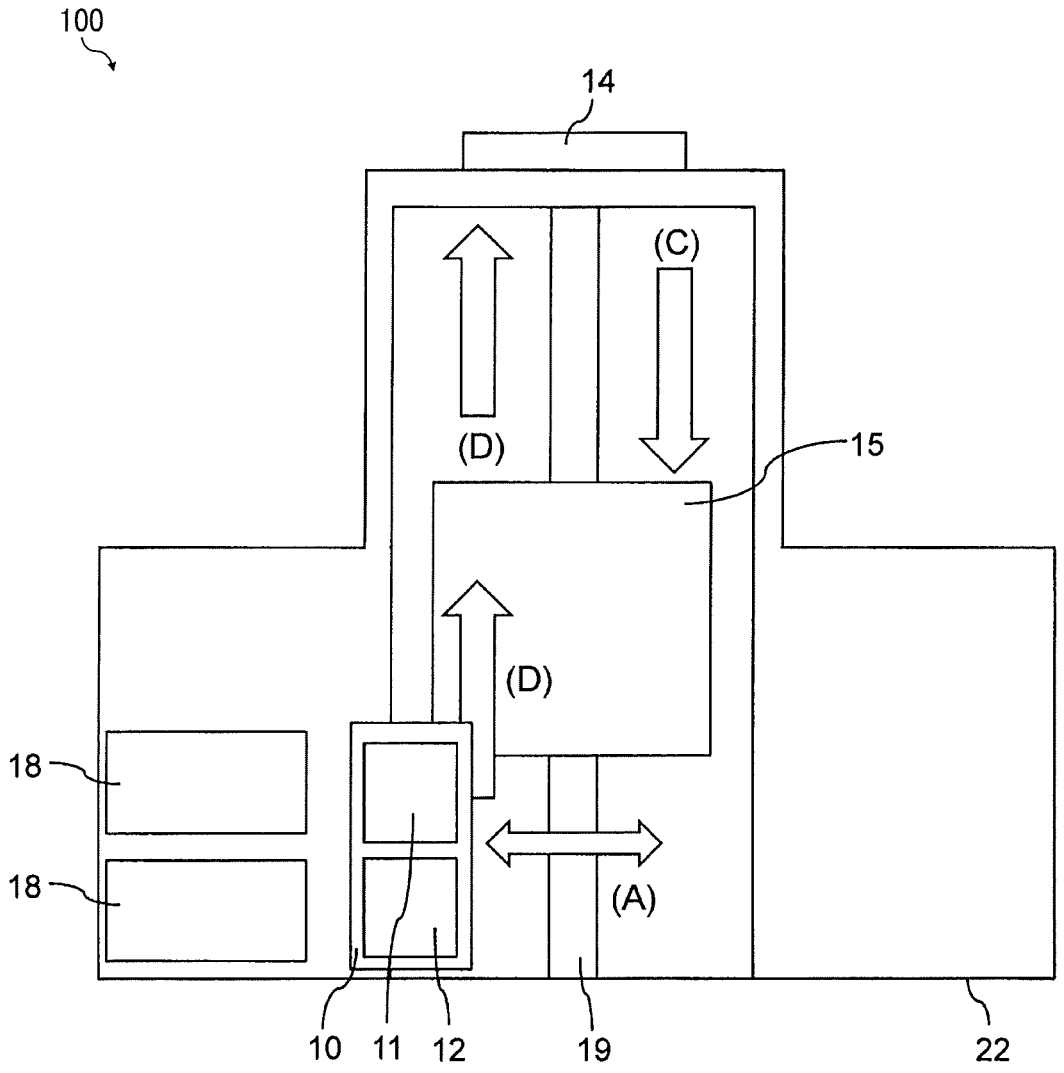
FIG. 15 is a schematic plan view of the liquid discharge apparatus according to the sixth embodiment.

FIG. 15 is a schematic plan view of the liquid discharge apparatus 100 according to the sixth embodiment of the present disclosure. The gas flow direction (D) is opposite to the sub-scanning direction (C) in FIG. 15.

Changing the position (arrangement) of the exhaust 14 can appropriately change the gas flow direction (D). Even in the configuration in the sixth embodiment in FIG. 15, the gas between the first head 11 and the platen 15 can flow upstream (upward in FIG. 15) in the sub-scanning direction (C).

Thus, the sixth embodiment can prevent the aggregation of the ink in the second head 12 disposed downstream (downward in FIG. 15) in the sub-scanning direction (C).

Seventh Embodiment

Next, another embodiment of the liquid discharge apparatus 100 according to a seventh embodiment of the present disclosure is described below.

Descriptions common to the above-described embodiment are omitted as appropriate.

Figure 16:
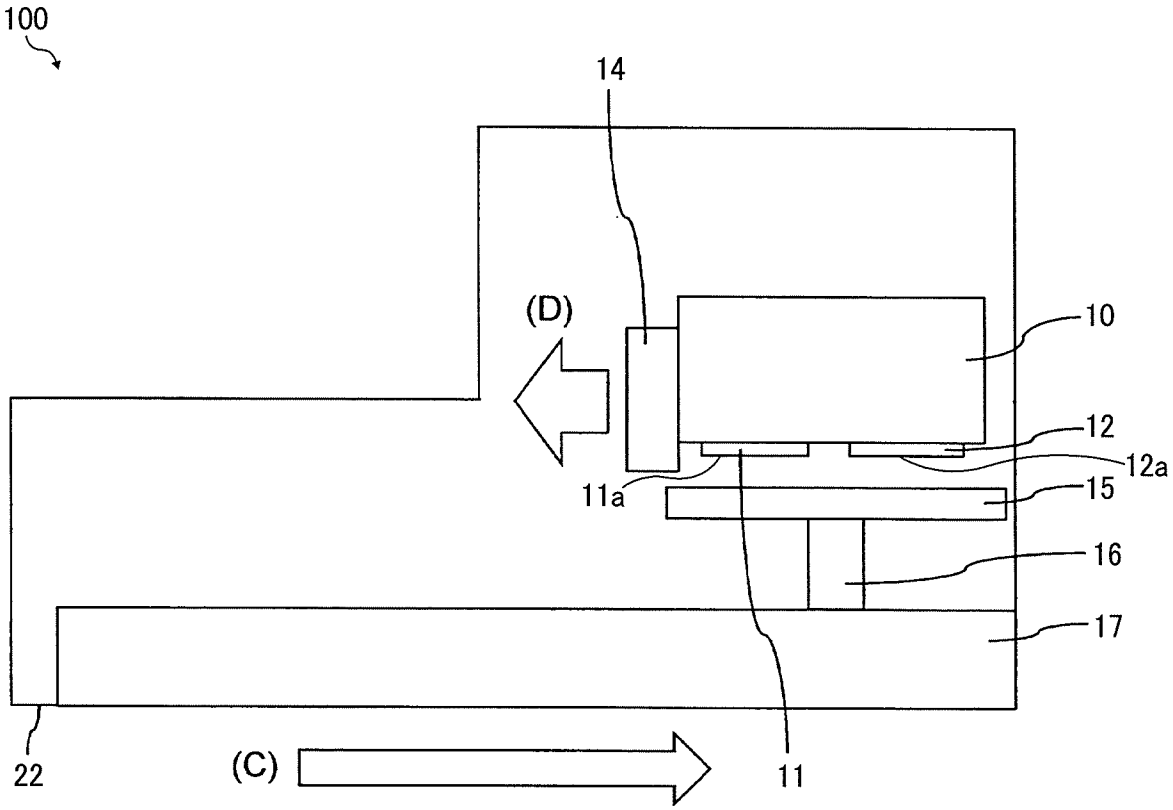
FIG. 16 is a schematic side view of the liquid discharge apparatus according to a seventh embodiment of the present disclosure.

In the liquid discharge apparatus 100 according to the seventh embodiment, the exhaust 14 is disposed upstream of the first head 11 in the sub-scanning direction (C) and is adjacent to the first head 11 in the sub-scanning direction (C) in FIG. 16.

FIG. 16 is a schematic side view of the liquid discharge apparatus 100 according to a seventh embodiment of the present disclosure.

In the seventh embodiment in FIG. 16, the exhaust 14 is disposed upstream of and adjacent to the first head 11 in the sub-scanning direction (C). In FIG. 16, the exhaust 14 is directly attached to the carriage 10. In other words, the carriage 10 directly mounts the exhaust 14.

Thus, the gas flow direction (D) of the gas formed by the exhaust 14 is less likely to change according to the position of the carriage 10. Thus, the seventh embodiment can stably exhaust the gas between the first head 11 and the platen 15.

According to the seventh embodiment, the gas exited between the first head 11 and the recording medium 30 can be stably exhausted to the upstream of the first head 11 in the sub-scanning direction (C). Thus, the gas is exhausted to the downstream of the first head 11 in the gas flow direction (D). Thus, the seventh embodiment can prevent aggregation of the ink caused by the gas that contains the mist of the pretreatment liquid discharged from the first head 11.

Further, the exhaust 14 is disposed closed to the first head 11, the exhaust 14 can exert a greater force on the gas existed in a space between the first head 11 and the recording medium 30 to exhaust the gas outside the space. Thus, the liquid discharge apparatus 100 can prevent the mist of the pretreatment liquid to adhere onto a nozzle surface 12*a* of the second head 12 to cause the non-discharge of the second head 12.

Eighth Embodiment

Next, another embodiment of the liquid discharge apparatus 100 according to a seventh embodiment of the present disclosure is described below.

Descriptions common to the above-described embodiment are omitted as appropriate.

Figure 17:
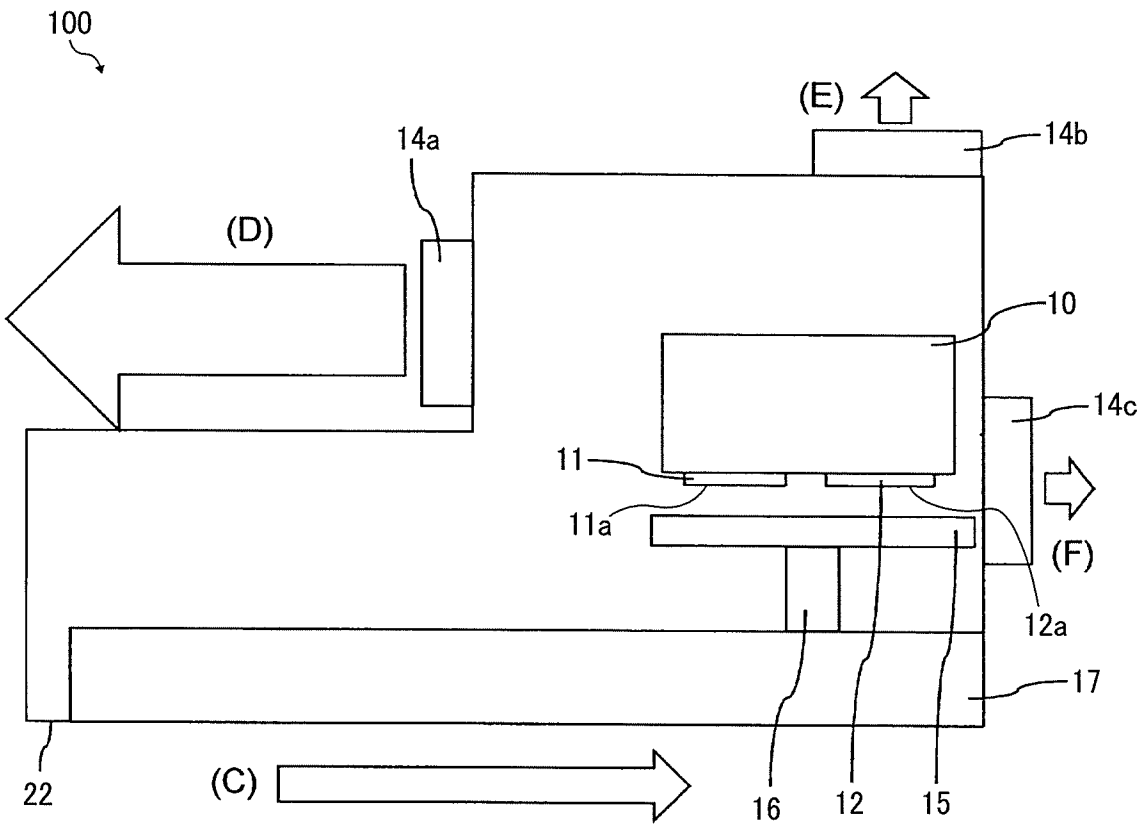
FIG. 17 is a schematic side view of the liquid discharge apparatus according to an eighth embodiment of the present disclosure.

The liquid discharge apparatus 100 in the eighth embodiment includes a plurality of exhausts 14*a* to 14*c* (see FIG. 17). The exhaust 14*a* disposed upstream of the first head 11 in the sub-scanning direction (C) can exert a larger suction force than a suction force exerted by the other exhausts 14*b* and 14*c*.

FIG. 17 is a schematic side view of the liquid discharge apparatus 100 according to the eighth embodiment of the present disclosure.

The exhaust 14*c* is disposed downstream of the second head 12 in the sub-scanning direction (C). The gas existed between the heads 11 and 12 and the recording medium 30 is preferably exhausted in a direction from the second head 12 toward the first head 11.

Thus, an exhaust 14*a* that can generate a large suction force (flow rate) is disposed upstream of the heads 11 and 12. Further, the suction force generated by the exhaust 14*a* is made larger than the suction force generated by other exhausts 14*b* and 14*c*.

Here, as illustrated in FIG. 17, the suction force (D) generated by the exhaust 14*a* is larger than the total suction force ((E)+(F)) generated by the other exhausts 14*b* and 14*c*.

Thus, the eighth embodiment can exhaust the gas existed between the first head 11 and the recording medium 30 to the upstream side in the sub-scanning direction (C), that is the downstream side in the gas flow direction (D). Thus, the liquid discharge apparatus 100 can prevent the mist of the pretreatment liquid to approach to a nozzle surface 12*a* of the second head 12 and aggregates the ink on the nozzle surface 12*a* of the second head 12.

Generally, the liquid discharge apparatus 100 includes a plurality of fans such as a heat exhaust fan, a cooling fan, and a drying fan in addition to a mist recovery fan. Even in such a case, if the liquid discharge apparatus 100 has a configuration in the eighth embodiment as illustrated in FIG. 17, the liquid discharge apparatus 100 can reduce aggregation of the ink.

Ninth Embodiment

Next, another embodiment of the liquid discharge apparatus 100 according to a ninth embodiment of the present disclosure is described below.

Descriptions common to the above-described embodiment are omitted as appropriate.

Figure 18:
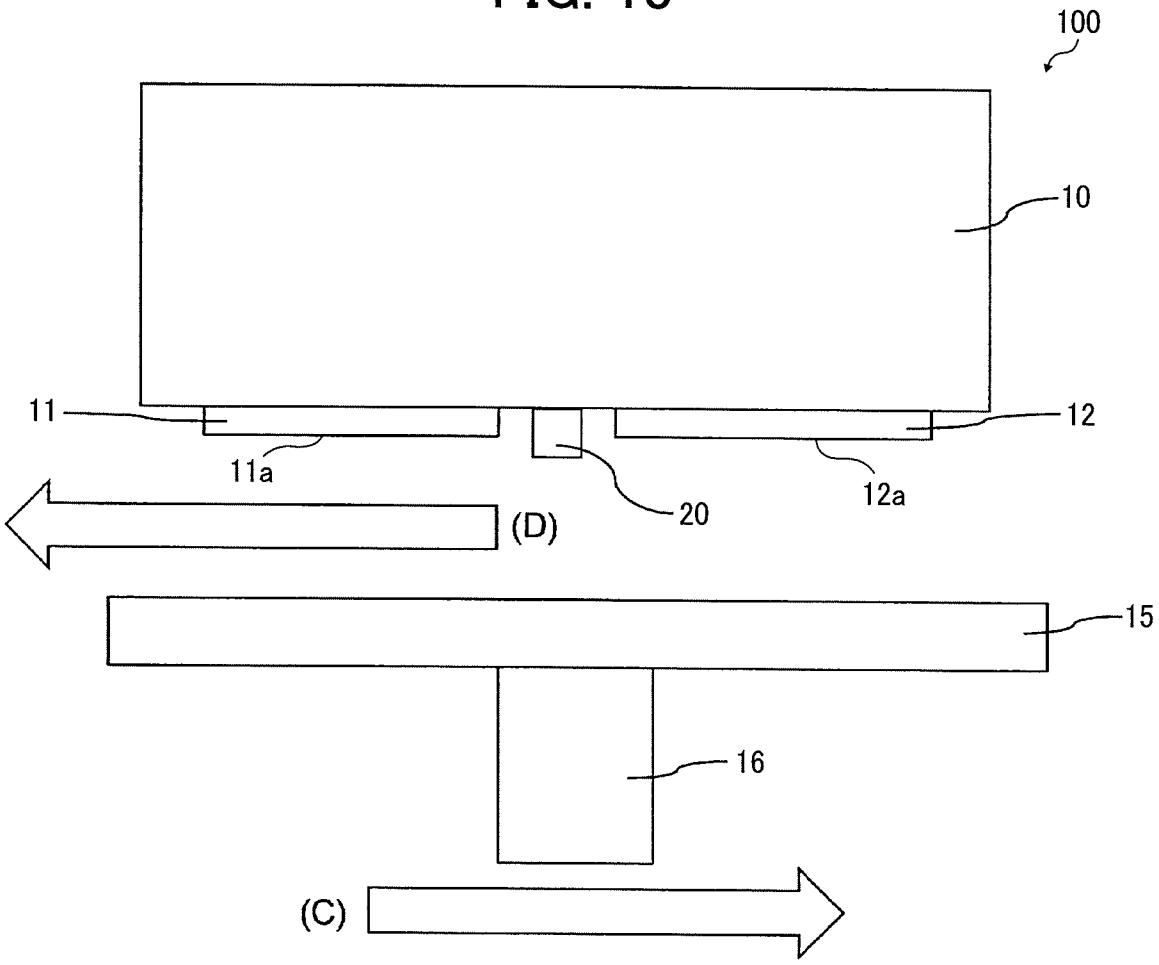
FIG. 18 is an enlarged schematic side view of a portion of the liquid discharge apparatus according to a ninth embodiment of the present disclosure.

FIG. 18 is an enlarged schematic side view of the liquid discharge apparatus 100 according to the ninth embodiment of the present disclosure. FIG. 18 schematically illustrates a portion of the liquid discharge apparatus 100.

The liquid discharge apparatus 100 according to the ninth embodiment includes a shield 20 disposed between the first head 11 and the second head 12 in the sub-scanning direction (C). Thus, the liquid discharge apparatus 100 can prevent the mist of the pretreatment liquid generated from the first head 11 to reach and adhere onto a nozzle surface 12*a* of the second head 12 to cause the non-discharge of the second head 12.

Further, the shield 20 of the ninth embodiment protrudes downward toward the recording medium 30 from the nozzle surface 11*a* of the first head 11. Since the lower end of the shield 20 protrudes downward from the nozzle surfaces 11*a* and 12*a* of the heads 11 and 12, the shield 20 can further prevent the mist of the pretreatment liquid from reaching the second head 12.

[Pretreatment Liquid]

The pretreatment liquid is not limited to any particular material as long as the pretreatment liquid is dischargeable from the heads 11 and 12 and may be selected from known pretreatment liquids. The pretreatment liquid preferably contains a polyvalent metal ion. The pretreatment liquid may optionally include other constituents such as a resin as necessary.

The polyvalent metal ion can be appropriately selected from known polyvalent metal ions. Specific examples of the polyvalent metal ion include, but are not limited to, calcium ion, magnesium ion, and aluminum ion, for example. Each of the groups of the polyvalent metal ion can be used alone or in combination with others.

A water-soluble polyvalent metal salt may be dissolved into the pretreatment liquid to prepare the pretreatment liquid containing the polyvalent metal ion. For example, carboxylates (acetic acid, lactic acid, etc.), sulfates, nitrates, chlorides, and thiocyanates are suitable as the polyvalent metal salt. One type of the polyvalent metal salt may be used alone, or two or more types of the polyvalent metal salts may be used in combination.

Among the polyvalent metal salts, carboxylates, sulfates, nitrates, and chlorides that have good solubility in water and water-soluble organic solvents are preferable from the viewpoints of image quality such as color developability and bleeding resistance, and discharge reliability.

The content of the polyvalent metal ion in the pretreatment liquid is preferably 30 mmol/L or more and 700 mmol/L from the viewpoints of prevention of bleeding and density unevenness, and improving color developability, fastness, and adhesion. The content of the polyvalent metal ion in the pretreatment liquid is more preferably 60 mmol/L or more and 500 mmol/L or less and is more preferably 100 mmol/L or more and 400 mmol/L or less.

[Ink]

The organic solvent, water, coloring material, resins, and additives for use in the ink are described below.

[Organic Solvent]

There is no specific limitation on the type of the organic solvent used in the present disclosure. For example, water-soluble organic solvents are usable.

Examples of water-soluble organic solvents include polyols, ethers (e.g., polyol alkyl ethers and polyol aryl ethers), nitrogen-containing heterocyclic compounds, amides, amines, and sulfur-containing compounds.

Specific examples of the polyols include, but are not limited to, ethylene glycol, diethylene glycol, 1,2-propanediol, 1,3-propanediol, 1,2-butanediol, 1,3-butanediol, 1,4-butanediol, 2,3-butanediol, 3-methyl-1,3-butanediol, triethylene glycol, polyethylene glycol, polypropylene glycol, 1,2-pentanediol, 1,3-pentanediol, 1,4-pentanediol 2,4-pentanediol, 1,5-pentanediol, 1,2-hexanediol, 1,6-hexanediol, 1,3-hexanediol, 2,5-hexanediol, 1,5-hexanediol, glycerin, 1,2,6-hexanetriol, 2-ethyl-1,3-hexanediol, ethyl-1,2,4-butanetriol, 1,2,3-butanetriol, 2,2,4-trimethyl-1,3-pentanediol, and petriol.

Examples of the polyol alkyl ethers include, but are not limited to, ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether.

Examples of polyol aryl ethers include, but are not limited to, ethylene glycol monophenyl ether and ethylene glycol monobenzyl ether.

Examples of nitrogen-containing heterocyclic compounds include, but are not limited to, 2-pyrrolidone, N-methyl-2-pyrrolidone, N-hydroxyethyl-2-pyrrolidone, 1,3-dimethyl-2-imidazolidinone, ε-caprolactam, and γ-butyrolactone.

Examples of the amides include, but are not limited to, formamide, N-methylformamide, N, N-dimethylformamide, 3-methoxy-N, N-dimethylpropionamide, and 3-butoxy-N, N-dim ethylpropionamide.

Examples of amines include, but are not limited to, monoethanolamine, diethanolamine, and triethylamine.

Examples of sulfur-containing compounds include, but are not limited to, dimethyl sulfoxide, sulfolane, and thiodiethanol.

Examples of other organic solvents include, but are not limited to, propylene carbonate and ethylene carbonate.

In particular, organic solvents having a boiling point of 250° C. or less are preferable, since they can function as a wetting agent while providing good drying property.

As the organic solvent, a polyol compound having 8 or more carbon atoms and a glycol ether compound are also preferably used. Specific examples of the polyol compounds having 8 or more carbon atoms include, but are not limited to, 2-ethyl-1,3-hexanediol and 2,2,4-trimethyl-1,3-pentanediol.

Specific examples of the glycol ether compounds include, but are not limited to, polyol alkyl ethers such as ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether; and polyol aryl ethers such as ethylene glycol monophenyl ether and ethylene glycol monobenzyl ether.

The polyol compounds having 8 or more carbon atoms and the glycol ether compounds are capable of improving paper-permeability of the ink, which is advantageous when paper is used as a recording medium 30.

The proportion of the organic solvent in the ink is not particularly limited and can be appropriately selected to suit to a particular application, but is preferably from 10% to 60% by mass, more preferably from 20% to 60% by mass, for drying property and discharge reliability of the ink.

[Water]

The proportion of water in the ink is not particularly limited and can be appropriately selected to suit to a particular application, but is preferably from 10% to 90% by mass, more preferably from 20% to 60% by mass, for drying property and discharge reliability of the ink.

[Colorant]

Examples of the colorant include, but are not limited to, pigments and dyes. Usable pigments include both inorganic pigments and organic pigments. One type of pigment can be used alone, or two or more types of pigments can be used in combination. Mixed crystals can also be used as the colorant.

Usable pigments include, but are not limited to, black pigments, yellow pigments, magenta pigments, cyan pigments, white pigments, green pigments, orange pigments, glossy color pigments (e.g., gold pigments and silver pigments), and metallic pigments.

Specific examples of inorganic pigments include, but are not limited to, titanium oxide, iron oxide, calcium carbonate, barium sulfate, aluminum hydroxide, Barium Yellow, Cadmium Red, Chrome Yellow, and carbon black produced by a known method such as a contact method, a furnace method, and a thermal method.

Specific examples of organic pigments include, but are not limited to, azo pigments, polycyclic pigments (e.g., phthalocyanine pigments, perylene pigments, perinone pigments, anthraquinone pigments, quinacridone pigments, dioxazine pigments, indigo pigments, thioindigo pigments, isoindolinone pigments, quinophthalone pigments), dye chelates (e.g., basic dye chelate, acid dye chelate), nitro pigments, nitroso pigments, and aniline black.

Among these pigments, the pigments having good affinity for solvents are preferable. In addition, hollow resin particles and hollow inorganic particles can also be used.

Specific examples of the pigments for black include, but are not limited to, carbon black (C.I. Pigment Black 7) such as furnace black, lamp black, acetylene black, and channel black, metals such as copper, iron (C.I. Pigment Black 11), and titanium oxide, and organic pigments such as aniline black (C.I. Pigment Black 1).

Specific examples of the pigments for color include, but are not limited to, C.I. Pigment Yellow 1, 3, 12, 13, 14, 17, 24, 34, 35, 37, 42 (yellow iron oxide), 53, 55, 74, 81, 83, 95, 97, 98, 100, 101, 104, 108, 109, 110, 117, 120, 138, 150, 153, 155, 180, 185, and 213; C.I. Pigment Orange 5, 13, 16, 17, 36, 43, and 51; C.I. Pigment Red 1, 2, 3, 5, 17, 22, 23, 31, 38, 48:2 (Permanent Red 2B (Ca)), 48:3, 48:4, 49:1, 52:2, 53:1, 57:1 (Brilliant Carmine 6B), 60:1, 63:1, 63:2, 64:1, 81, 83, 88, 101 (rouge), 104, 105, 106, 108 (Cadmium Red), 112, 114, 122 (Quinacridone Magenta), 123, 146, 149, 166, 168, 170, 172, 177, 178, 179, 184, 185, 190, 193, 202, 207, 208, 209, 213, 219, 224, 254, and 264; C.I. Pigment Violet 1 (Rohdamine Lake), 3, 5:1, 16, 19, 23, and 38; C.I. Pigment Blue 1, 2, 15 (Phthalocyanine Blue), 15:1, 15:2, 15:3, 15:4, (Phthalocyanine Blue), 16, 17:1, 56, 60, and 63; C.I. Pigment Green 1, 4, 7, 8, 10, 17, 18, and 36.

The dyes are not particularly limited, and acid dyes, direct dyes, reactive dyes, and basic dyes can be used. Each of dyes can be used alone or in combination with other dyes.

Specific examples of the dyes include, but are not limited to, C.I. Acid Yellow 17, 23, 42, 44, 79, and 142, C.I. Acid Red 52, 80, 82, 249, 254, and 289, C.I. Acid Blue 9, 45, and 249, C.I. Acid Black 1, 2, 24, and 94, C. I. Food Black 1 and 2, C.I. Direct Yellow 1, 12, 24, 33, 50, 55, 58, 86, 132, 142, 144, and 173, C.I. Direct Red 1, 4, 9, 80, 81, 225, and 227, C.I. Direct Blue 1, 2, 15, 71, 86, 87, 98, 165, 199, and 202, C.I. Direct Black 19, 38, 51, 71, 154, 168, 171, and 195, C.I. Reactive Red 14, 32, 55, 79, and 249, and C.I. Reactive Black 3, 4, and 35.

The proportion of the colorant in the ink is preferably from 0.1% to 15% by mass, more preferably from 1% to 10% by mass, for improving image density, fixability, and discharge stability.

Examples of the method of dispersing the pigment in the ink include, but are not limited to, a method of introducing a hydrophilic functional group to the pigment to make the pigment self-dispersible, a method of covering the surface of the pigment with a resin to disperse the pigment; and a method of dispersing the pigment by a dispersant. In the method of introducing a hydrophilic functional group to the pigment to make the pigment self-dispersible, for example, a functional group such as sulfone group and carboxyl group may be introduced to the pigment (e.g., carbon) to make the pigment dispersible in water.

In the method of covering the surface of the pigment with a resin, for example, the pigment may be incorporated in a microcapsule to make the pigment self-dispersible in water. This pigment may be referred to as a resin-covered pigment. Not all the pigment particles included in the ink should be covered with a resin in the resin-covered pigment.

A part of the pigment particles may not be covered with any resin or may partially be covered with a resin unless such pigments have an adverse effect. In the method of dispersing the pigment by a dispersant, low-molecular dispersants and high-molecular dispersants, represented by known surfactants, may be used.

More specifically, any of anionic surfactants, cationic surfactants, ampholytic surfactants, and nonionic surfactants may be used as the dispersant depending on the property of the pigment.

As a dispersant, RT-100 (nonionic surfactant) manufactured by Takemoto Oil & Fat Co., Ltd. and naphthalenesulfonic acid Na formalin condensate can also be suitably used as the dispersant.

One dispersant can be used alone, and two or more dispersants can be used in combination.

[Pigment Dispersion]

The ink can be obtained by mixing a pigment with other materials such as water and an organic solvent. The ink can also be obtained by, first, preparing a pigment dispersion by mixing a pigment with water, a dispersant, etc., and then mixing the pigment dispersion with other materials such as water and an organic solvent.

The pigment dispersion is obtained by mixing and dispersing water, a pigment, a pigment dispersant, and other components as necessary, and adjusting the particle size. Preferably, the dispersing is performed by a disperser.

The particle diameter of the pigment dispersed in the pigment dispersion is not particularly limited, but the number-based maximum frequency particle diameter is preferably in the range of from 20 to 500 nm, more preferably from 20 to 150 nm, for improving dispersion stability of the pigment and discharge stability and image quality (e.g., image density) of the ink. The particle diameter of the pigment can be measured with a particle size analyzer (NANOTRAC WAVE-UT151 manufactured by Microtrac-BEL Corp.).

The proportion of the pigment in the pigment dispersion is not particularly limited and can be suitably selected to suit to a particular application, but is preferably from 0.1% to 50% by mass, more preferably from 0.1% to 30% by mass, for improving discharge stability and enhancing image density.

Preferably, the pigment dispersion is preferably subjected to filtration using a filter or a centrifugal separator to remove coarse particles, followed by degassing, if necessary.

[Resin]

The type of the resin contained in the ink is not particularly limited and can be suitably selected to suit to a particular application. Specific examples of the resin contained in the ink include urethane resins, polyester resins, acrylic resins, vinyl acetate resins, styrene resins, butadiene resins, styrene-butadiene resins, vinyl chloride resins, acrylic styrene resins, and acrylic silicone resins.

Resin particles made of the above-described resins may also be used. The resin particles may be dispersed in water as a dispersion medium to prepare a resin emulsion. The ink can be obtained by mixing the resin emulsion with other materials such as a colorant and an organic solvent. The resin particles may be suitably synthesized or a commercial product. The resin particles may include one type of resin used alone or two or more types of resin particles used in combination.

The volume average particle diameter of the resin particles is not particularly limited and can be suitably selected to suit to a particular application, but is preferably from 10 to 1,000 nm, more preferably from 10 to 200 nm, and particularly preferably from 10 to 100 nm, for good fixability and high image hardness.

The volume average particle diameter can be measured using, for example, a particle size analyzer (Nanotrack Wave-UT151 manufactured by Microtrack Bell Co., Ltd.).

The content of the resin is not limited to any particular value and varied in accordance with the intended purpose. The proportion of the resin in the ink is preferably from 1% to 30% by mass, more preferably from 5% to 20% by mass based on the total amount of the ink, for fixability and storage stability of the ink.

The particle diameter of solid contents in the ink is not particularly limited and can be appropriately selected according to the purpose. The number-based maximum frequency of particle diameter of solid contents in the ink is preferably in the range of from 20 to 1,000 nm, more preferably from 20 to 150 nm, for improving discharge stability and image quality (e.g., image density). The solid contents include the resin particles and pigment particles. The particle diameter can be measured with a particle size analyzer (NANOTRAC WAVE-UT151 manufactured by MicrotracBEL Corp.).

[Additives]

The ink may further contain a surfactant, a defoamer, a preservative, a fungicide, a corrosion inhibitor, and/or a pH adjuster.

[Surfactant]

Usable surfactants include silicone-based surfactants, fluorine-based surfactants, ampholytic surfactants, nonionic surfactants, and anionic surfactants. The silicone-based surfactant is not particularly limited and can be suitably selected to suit to a particular application.

Preferred are silicone-based surfactants which are not decomposed even in a high pH environment.

Specific examples of the silicone-based surfactants include, but are not limited to, side-chain-modified polydimethylsiloxane, both-end-modified polydimethylsiloxane, one-end-modified polydimethylsiloxane, and side-chain-both-end-modified polydimethylsiloxane.

In particular, the silicone-based surfactants having a polyoxyethylene group and/or a polyoxyethylene polyoxypropylene group as the modifying group are preferable because the above-described silicone-based surfactants demonstrate good characteristics as an aqueous surfactant.

Specific examples of the silicone-based surfactants further include polyether-modified silicone-based surfactants, such as a dimethyl siloxane compound having a polyalkylene oxide structure on a side chain which is bound to Si atom.

Specific preferred examples of the fluorine-based surfactants include, but are not limited to, perfluoroalkyl sulfonic acid compounds, perfluoroalkyl carboxylic acid compounds, perfluoroalkyl phosphate ester compounds, perfluoroalkyl ethylene oxide adducts, and polyoxyalkylene ether polymer compounds having a perfluoroalkyl ether group on a side chain, each of which have weak foaming property.

Specific examples of the perfluoroalkyl sulfonic acid compounds include, but are not limited to, perfluoroalkyl sulfonic acid and perfluoroalkyl sulfonate.

Specific examples of the perfluoroalkyl carboxylic acid compounds include, but are not limited to, perfluoroalkyl carboxylic acid and perfluoroalkyl carboxylate.

Specific examples of the polyoxyalkylene ether polymer compounds having a perfluoroalkyl ether group on a side chain include, but are not limited to, a sulfate ester salt of a polyoxyalkylene ether polymer having a perfluoroalkyl ether group on a side chain, and a salt of a polyoxyalkylene ether polymer having a perfluoroalkyl ether group on a side chain.

Specific examples of the counter ions of the salt for the above-described fluorine-based surfactants include, but are not limited to, Li, Na, K, $NH_4$, $NH_3$ $CH_2CH_2OH$, $NH_2(CH_2CH_2OH)_2$, and $NH(CH_2CH_2OH)_3$.

Specific examples of the ampholytic surfactants include, but are not limited to, laurylaminopropionate, lauryl dimethyl betaine, stearyl dimethyl betaine, and lauryl hydroxyethyl betaine.

Specific examples of the nonionic surfactants include, but are not limited to, polyoxyethylene alkyl phenyl ethers, polyoxyethylene alkyl esters, polyoxyethylene alkyl amines, polyoxyethylene alkyl amides, polyoxyethylene propylene block polymers, sorbitan fatty acid esters, polyoxyethylene sorbitan fatty acid esters, and ethylene oxide adducts of acetylene alcohol.

Specific examples of the anionic surfactants include, but are not limited to, polyoxyethylene alkyl ether acetate, dodecylbenzene sulfonate, laurate, and polyoxyethylene alkyl ether sulfate.

Each type of the above-described defoamers can be used alone or in combination with others.

The silicone-based surfactants are not particularly limited and can be suitably selected to suit to a particular application.

Specific examples of the silicone-based surfactants include, but are not limited to, side-chain-modified polydimethylsiloxane, both-end-modified polydimethylsiloxane, one-end-modified polydimethylsiloxane, and side-chain-and-both-end-modified polydimethylsiloxane.

In particular, polyether-modified silicone-based surfactants having a polyoxyethylene group and/or a polyoxyethylene polyoxypropylene group as the modifying group are preferable because the above-described silicone-based surfactants demonstrate good characteristics as an aqueous surfactant.

The above-described surfactants are available either synthetically or commercially. Commercial products are readily available from, for example, BYK Japan KK, Shin-Etsu Chemical Co., Ltd., Dow Corning Toray Co., Ltd., Nihon Emulsion Co., Ltd., and Kyoeisha Chemical Co., Ltd.

The polyether-modified silicone-based surfactants are not particularly limited and can be suitably selected to suit to a particular application.

Examples of the polyether-modified silicone-based surfactants include the polyether-modified silicone-based surfactants obtained by introducing a polyalkylene oxide structure represented by the general formula (S-1) into the side chain of the Si portion of dimethylpolysiloxane.

[Chemical Formula 1]

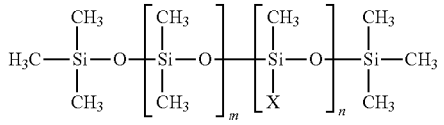

$X = -R(C_2H_4O)_a(C_3H_6O)_bR'$

Chemical Formula S-1

In the general formula (S-1), each of m, n, a, and b independently represents an integer. In the general formula (S-1), R represents an alkylene group, and R' represents an alkyl group.

A commercially available product can be used for the above-described polyether-modified silicone-based surfactants.

Specific examples of commercially-available polyether-modified silicone-based surfactants include, but are not limited to: KF-618, KF-642, and KF-643 (manufactured by Shin-Etsu Chemical Co., Ltd.); EMALEX-SS-5602 and SS-1906EX (manufactured by Nihon Emulsion Co., Ltd.); FZ-2105, FZ-2118, FZ-2154, FZ-2161, FZ-2162, FZ-2163, and FZ-2164 (manufactured by Dow Corning Toray Co., Ltd); BYK-33 and BYK-387 (manufactured by BYK Japan KK); and TSF4440, TSF4452, and TSF4453 (manufactured by Dow Corning Toray Co., Ltd.).

Preferably, the fluorine-based surfactant is a compound having 2 to 16 fluorine-substituted carbon atoms, more preferably a compound having 4 to 16 fluorine-substituted carbon atoms.

Specific examples of the fluorine-based surfactants include, but are not limited to, perfluoroalkyl phosphate ester compounds, perfluoroalkyl ethylene oxide adducts, and polyoxyalkylene ether polymer compounds having a perfluoroalkyl ether group on a side chain.

Among the fluorine-based surfactants, polyoxyalkylene ether polymer compounds having a perfluoroalkyl ether group on a chain are preferable since the polyoxyalkylene ether polymer compounds having a perfluoroalkyl ether group is less likely to foam.

More specifically, the fluorine-based surfactants represented by the following formulas (F-1) and (F-2) are preferable.

[Chemical Formula 2]

$$CF_3CF_2(CF_2CF_2)_m-CH_2CH_2O(CH_2CH_2O)_nH \quad \text{Chemical formula F-1}$$

In the formula (F-1), to have water-solubility, "m" is preferably an integer of from 0 to 10, and "n" is preferably an integer of from 0 to 40.

[Chemical Formula 3]

$$C_nF_{2n+1}-CH_2CH(OH)CH_2-O-(CH_2CH_2O)_n-Y \quad \text{Chemical formula F-2}$$

In the general formula (F-2), Y represents H, $C_mF_{2m+1}$ (where m represents an integer of from 1 to 6), $CH_2CH(OH)CH_2-C_mF_{2m+1}$ (where m represents an integer of from 4 to 6), or $C_pH_{2p+1}$ (where p represents an integer of from 1 to 19). "n" represents an integer of from 1 to 6, and "a" represents an integer of from 4 to 14.

The fluorine-based surfactants are available either synthetically or commercially.

Specific examples of commercially-available fluorine-based surfactants include, but are not limited to: SURFLON S-111, S-112, 5-113, S-121, S-131, S-132, S-141, and S-145 (manufactured by AGC Inc.); Fluorad™ FC-93, FC-95, FC-98, FC-129, FC-135, FC-170C, FC-430, and FC-431 (manufactured by 3M Japan Ltd.); MEGAFACE F-470, F-1405, and F-474 (manufactured by DIC Corporation); Zonyl™ TBS, FSP, FSA, FSN-100, FSN, FSO-100, FSO, FS-300, and UR, CAPSTONE™ FS-30, FS-31, FS-3100, FS-34, FS-35 (manufactured by The Chemours Company); FT-110, FT-250, FT-251, FT-400S, FT-150, and FT-400SW (manufactured by NEOS COMPANY Ltd.); POLYFOX PF-136A, PF-156A, PF-151N, PF-154, and PF-159 (manufactured by OMNOVA SOLUTIONS Inc.), and UNIDYNE DSN-403N (manufactured by DAIKIN INDUSTRIES, Ltd.).

Among the fluorine-based surfactants, FS-3100, FS-34, and FS-300 (manufactured by The Chemours Company), FT-110, FT-250, FT-251, FT-400S, FT-150, and FT-400SW (manufactured by NEOS COMPANY Ltd.), POLYFOX PF-151N (manufactured by OMNOVA SOLUTIONS Inc.), and UNIDYNE DSN-403N (manufactured by DAIKIN INDUSTRIES, Ltd.) are particularly preferable in terms of good printing quality, in particular coloring, and improvement on permeation to paper, wettability, and uniform dying property.

The proportion of the surfactant in the ink is not particularly limited and can be suitably selected to suit to a particular application. The proportion of the surfactant in the ink is preferably from 0.001% to 5% by mass, more preferably from 0.05% to 5% by mass, for improving wettability and discharge stability and enhancing image quality.

[Defoamer]

Specific examples of the defoamer include, but are not limited to, silicone-based defoamers, polyether-based defoamers, and fatty-acid-ester-based defoamers.

Each type of the above-described defoamers can be used alone or in combination with others. Among the above-described defoamers, silicone-based defoamers are preferable since the silicone-based defoamers have excellent defoaming ability.

[Preservative and Fungicide]

Specific examples of the preservative and fungicide include, but are not limited to, 1,2-benzisothiazoline-3-one.

[Corrosion Inhibitor]

Specific examples of the corrosion inhibitor include, but are not limited to, acid sulfate and sodium thiosulfate.

[pH Adjuster]

The pH adjuster is not particularly limited as long as it is capable of adjusting the pH to 7 or higher. Specific examples the pH adjuster include, but are not limited to, amines such as diethanolamine and triethanolamine.

[Ink Properties]

The properties of the ink are not particularly limited and can be suitably selected to suit to a particular application. For example, viscosity, surface tension, and pH are preferably in the following ranges.

Viscosity of the ink at 25° C. is preferably from 5 to 30 mPa·s and more preferably from 5 to 25 mPa·s to improve print density and text quality and obtain good dischargeability. Viscosity of the ink can be measured by, for example, a rotatory viscometer (RE-80L manufactured by TOKI SANGYO CO., Ltd.).

The measuring condition are: a standard cone rotor (1°34'χ×R24), sample liquid amount: 1.2 mL, number of rotations: 50 rotations per minute (rpm) and measuring time: 3 minutes.

Preferably, the surface tension of the ink is 35 mN/m or less, more preferably 32 mN/m or less, at 25° C., so that the ink is suitably levelized on a recording medium and the drying time of the ink is shortened.

Preferably, the pH of the ink is from 7 to 12, more preferably from 8 to 11, to prevent corrosion of metal materials contacting the ink.

[Aftertreatment Liquid]

The aftertreatment liquid is not particularly limited as long as the aftertreatment liquid can form a transparent layer.

The aftertreatment liquid may be obtained by mixing a material selected from organic solvent, water, a resin, a surfactant, a defoamer, a pH adjuster, a preservative, a fungicide, and/or a corrosion inhibitor as necessary.

The aftertreatment liquid can be applied to the entire recording area on a recording medium or only an area onto which an ink image has been formed.

EMBODIMENTS

Hereinafter, the present disclosure is described with reference to examples and comparative examples. However, the present disclosure is not limited to the examples as described below. In the following descriptions, "parts" represent "parts by mass" unless otherwise specified.

[Preparation of Black Pigment Dispersion]

The materials listed below were premixed.

A black pigment dispersion (pigment concentration: 15% by mass) was obtained by circulating and dispersing for 7 hours with a disk-type bead mill (manufactured by Shinmaru Enterprises Corporation, KDL type, media: 0.3 mm diameter zirconia ball).

Carbon black pigment (MONARCH 800 manufactured by Cabot Corporation): 15 parts by mass.

Anionic surfactant (PIONINE A-51-B manufactured by Takemoto Oil & Fat Co., Ltd.): 2 parts by mass.

Ion-exchange water: 83 parts

[Preparation of Titanium Oxide Dispersion Liquid]

A titanium oxide dispersion liquid is obtained by following procedures. 30.8 parts by mass of high-purity water and 1.2 parts by mass of a dispersant (DISPERBYK-190 manufactured by BYK Japan KK) were added in a dispersion container, and the mixture of the above-described material was lightly stirred and homogenized.

Then, 32.0 parts by mass of titanium dioxide (GTR-100 manufactured by Sakai Chemical Industry Co., Ltd., primary particle size: 260 nm, crystal form: rutile type, organic treatment product for water dispersion) were further added to the dispersion container.

The dispersion liquid is treated homogenized with an ultrasonic homogenizer (US-300T manufactured by NISSEI Corporation, chip: φ26) at 200 μA for 1 hour while the dispersion liquid is cooled with water.

The dispersion liquid was filtered through a 5 μm cellulose acetate membrane filter (Minisart 17594K manufactured by Sartorius Japan K.K.) to obtain a titanium dioxide dispersion having a solid content of 50% by mass.

The volume average particle diameter (D50) of the titanium oxide dispersion was 352 nm.

[Preparation of Resin Particle Dispersion Liquid 1]

A resin particle dispersion liquid 1 was obtained by the following procedure. First, 87.0 parts of ion-exchanged water was added to a 300 mL flask equipped with a stirrer, a thermometer, a nitrogen gas inlet pipe, and a reflux pipe, was heated to 70° C. under a nitrogen stream, and was held for 2 hours.

Further, 30.0 parts of methyl methacrylate, 52.0 parts of 2-ethylhexyl acrylate, methoxypolyethylene glycol methacrylate (PME-1000 manufactured by NOF CORPORATION), 2.5 parts of vinyltriethoxysilane, 1.5 parts of anionic surfactants (AQUALON (HITENOL) HS-10 manufactured by DKS Co. Ltd.), and 42.9 parts of ion-exchanged water were mixed and adjusted to prepare an emulsion emulsified with a homomixer.

Next, 3.0 parts of 10% anionic surfactant aqueous solution (AQUALON (HITENOL) HS-10 manufactured by DKS Co. Ltd.) and 2.6 parts of 5% ammonium persulfate aqueous solution were added to the flask, and then the emulsion was continuously dripped over 2.5 hours.

Further, 0.5 part of 5% ammonium persulfate aqueous solution was added in every hour until 3 hours had been elapsed from a start of dripping.

After completion of dripping, the mixture was aged at 70° C. for 2 hours, cooled to room temperature, adjusted to pH 7 to 8 with 28% aqueous ammonia, and adjusted to 30% solids with ion-exchanged water, and the resin particle dispersion 1 was thus obtained.

[Preparation of Resin Particle Dispersion Liquid 2]

Hereinafter, the resin particle dispersion 2 was obtained by the following procedure.

First, 75 parts of polycarbonate diol (T5651 manufactured by Asahi Kasei Corporation), 8 parts of dimethylolpropionic acid, 50 parts of isophorone diisocyanate, 90 parts of acetone dehydrated with molecular sieves were added in a 500 mL separable flask equipped with a stirrer, a thermometer, and a reflux tube.

The mixture was heated up to 70° C. under a nitrogen stream.

Then, 200 ppm of Tin 2-Ethyl Hexanoate were added to the mixture.

The mixture was reacted at 70° C. for 3 to 10 hours while measuring the isocyanate concentration in the system.

Next, the temperature in the system was lowered to 40° C., and after triethylamine was added to the mixture as necessary, 270 parts of ion-exchanged water was added while the mixture was stirred at a speed of 300 rpm.

After the mixture was stirred for one hour, 7 parts of 2-methyl-1 and 5-pentanediamine were added, and the mixture was stirred for 3 to 6 hours.

Then, the mixture was cooled to room temperature, and the solvent was distilled away with an evaporator.

Then, the solid content of the mixture is adjusted to 30% with ion-exchanged water, and the resin particle dispersion 2 was thus obtained.

[Preparation of Pretreatment Liquid]

The materials of the following formulation were mixed and stirred for one hour. Then, the mixture was pressure filtrated with a 1.2 μm cellulose acetate membrane filter to obtain a pretreatment liquid. Then, ion exchange water was added to the mixture so that the number of total parts became 100 parts.

Propylene glycol: 20 parts 3-methoxy-3-methyl-1-butanol: 10 parts

Wet 270 (manufactured by EVONIK JAPAN Co., Ltd): 0.5 part

BYK348 (manufactured by BYK Japan KK): 0.5 part

Envirogem™ AD01 (manufactured by Air Products and Chemicals, Inc.): 0.5 parts

Proxel LV (manufactured by LONZA): 0.3 parts

Magnesium chloride hexahydrate: 5 parts

Resin particle dispersion 1: 25 parts

[Preparation of Black Ink]

The materials of the following formulation were mixed and stirred for one hour. Then, the mixture was pressure filtrated with a 1.2 μm cellulose acetate membrane filter to obtain a black ink. Then, ion exchange water was added to the mixture so that the number of total parts became 100 parts.

Propylene glycol: 20 parts

Triethylene glycol: 5 parts

Wet 270 (manufactured by EVONIK JAPAN Co., Ltd): 0.5 part

BYK348 (manufactured by BYK Japan KK): 0.5 part

Envirogem™ AD01 (manufactured by Air Products and Chemicals, Inc.): 0.5 parts

Proxel LV (manufactured by LONZA): 0.3 parts

Black pigment dispersion: 33 parts

Resin particle dispersion 2: 30 parts

[Preparation of White Ink]

The materials of the following formulation were mixed and stirred for one hour. Then, the mixture was pressure filtrated with a 1.2 μm cellulose acetate membrane filter to obtain a black ink. Then, ion exchange water was added to the mixture so that the number of total parts became 100 parts.

Propylene glycol: 15 parts

Triethylene glycol: 10 parts

Wet 270 (manufactured by EVONIK JAPAN Co., Ltd): 0.5 parts

BYK348 (manufactured by BYK Japan KK): 0.5 part

Envirogem™ AD01 (manufactured by Air Products and Chemicals, Inc.): 0.5 parts

Proxel LV (manufactured by LONZA): 0.3 parts

Titanium dioxide pigment dispersion: 30 parts

Resin particle dispersion 2: 30 parts

Examples 1 to 3 and Comparative Examples 1 and 2

Examples 1 to 3 and Comparative Examples 1 and 2 were executed using the liquid discharge apparatus according to the first embodiment.

As illustrated in Table 1 below, the distance (gap) between the first head 11 and the platen 15 was changed. The black ink and the white ink were filled in the second head 12.

In Table 1, Example 1 is referred to as EX1, Example 2 is referred to as EX2, Example 3 is referred to as EX3, Comparative Example 1 is referred to as CE1, and Comparative Example 2 is referred to as CE2.

In each of Examples 1 to 3 and Comparative Examples 1 and 2, the distance (gap) between the second head 12 and the platen 15 was set identical to the distance (gap) between the first head 11 and the platen 15. In Comparative Example 2, printing was performed without operating the heater.

The following was evaluated for each of the Examples 1 to 3 and the Comparative Examples 1 and 2.

[Discharge Reliability Evaluation]

The liquid discharge apparatus 100 according to the first embodiment was filled with the pretreatment liquid, and the discharge reliability after discharging the pretreatment liquid was evaluated.

First, in an environment of 25° C. and 20% RH, head cleaning was executed by a printer maintenance command.

Then, a test chart was printed and was confirmed that all the channels of the nozzles 11*c* and 12*c* were in a discharge state.

Next, the heater 40 was set to 50° C., and solid images were continuously printed for one hour. The, the head cleaning was executed once by the printer maintenance command, and the test chart was printed again.

A number of non-discharge channels was counted from the test chart before and after the liquid discharge apparatus 100 was being left, and the discharge reliability was judged according to the following criteria.

To determine the discharge of the pretreatment liquid, the pretreatment liquid was colored with a blue dye to the extent that first head 11 can discharge the pretreatment liquid.

[Evaluation Criteria]

Excellent: Less than one non-discharge channel

Good: Number of non-discharge channels is less than 3

Acceptable: Number of non-discharge channels is 3 or more and less than 10

Poor: More than 10 non-discharge channels

[Evaluation of Bleeding of Plastic Film]

The liquid discharge apparatus 100 according to the first embodiment was filled with the pretreatment liquid, the black ink, and the white ink.

Then, the pretreatment liquid is uniformly applied to a corona-treated surface of a 20 μm-thick pyrene film P2111 (manufactured by TOYOBO Co., Ltd) at an adhesion amount of 0.5 mg/cm$^2$.

Then, the white ink is applied on the corona-treated surface at an adhesion amount of 2.0 mg/cm$^2$ in an undried state to form a solid image of the white ink.

Immediately after the application of the white ink, the black ink was applied on the solid image of the white ink at an adhesion amount of 1.0 mg/cm$^2$ to form a solid image of the black ink having an area smaller than an area of the solid image of the white ink.

Further, the image is dried for one minute in a hot-air circulation-type thermostat that is set to 100° C. to obtain the image for evaluation.

The boundary between the solid image of the black ink and the solid image of the white ink of the obtained image for evaluation was evaluated according to the following criteria.

[Evaluation Criteria]

Good: There is no bleeding at the boundary of the image, and the image is clear.

Acceptable: Slight bleeding is observed at the boundary of the image, but a level of the image is practically acceptable.

Poor: Noticeable bleeding is observed at the boundary of the image, and the level of the image is practically unacceptable.

[Evaluation of Fabric Bleeding]

The liquid discharge apparatus 100 according to the first embodiment was filled with the pretreatment liquid and the black ink.

Then, the pretreatment liquid is uniformly applied to a polyester T-shirt (glimmer 00300-ACT, white, thickness of about 1 mm) manufactured by TOMS Co., Ltd. with an adhesion amount of 0.5 mg/cm$^2$.

Then, the black ink is applied on the T-shirt at an adhesion amount of 1.5 mg/cm$^2$ in an undried state to form a solid image of the black ink.

Further, the image is dried for one minute with a heat press that is set to 160° C. to obtain the image 1 for evaluation of fabric bleeding.

The liquid discharge apparatus 100 according to the first embodiment was filled with the pretreatment liquid, the black ink, and the white ink.

Then, the pretreatment liquid is uniformly applied to a polyester T-shirt (printstar 00085-CVT, black, thickness of about 1 mm) manufactured by TOMS Co., Ltd. with an adhesion amount of 3.0 mg/cm$^2$.

Then, the white ink is applied on the T-shirt at an adhesion amount of 15.0 mg/cm$^2$ in an undried state to form a solid image of the white ink.

Immediately after the application of the white ink, the black ink was applied on the solid image of the white ink at an adhesion amount of 1.5 mg/cm$^2$ to form a solid image of the black ink having an area smaller than an area of the solid image of the white ink. Further, the image is dried for one minute with the heat press set to 160° C. to obtain an image 2 for evaluation of fabric bleeding.

Further, the thicknesses of the polyester T-shirt and the cotton T-shirt were measured after the T-shirts were flattened with a pressing member. A portion excluding the fuzzy portion was defined as the thickness of the recording medium 30.

A boundary between the solid image of the black ink of the image 1 for evaluation of the fabric bleeding and a base of the T-shirt was evaluated according to the following criteria.

Further, a boundary between the solid image of the black ink and the solid image of the white ink of the obtained image 2 for evaluation of the fabric bleeding was evaluated according to the following criteria.

The evaluation results of the above-described images for evaluation were combined to make a comprehensive evaluation.

[Evaluation Criteria for Each Evaluation Image]

Good: There is no bleeding at the boundary of the image, and the image is clear.

Acceptable: Slight bleeding is observed at the boundary of the image, but a level of the image is practically acceptable.

Poor: Noticeable bleeding is observed at the boundary of the image, and the level of the image is practically unacceptable.

[Comprehensive Evaluation Criteria]

Good: Fabric bleeding of both of images 1 and 2 is Good.

Acceptable: At least one of the evaluations of fabric bleeding of images 1 and 2 is acceptable, and both of the evaluations of the fabric bleeding of images 1 and 2 are not poor.

Poor: At least one of evaluation of fabric bleeding of images 1 and 2 is poor.

The obtained results are illustrated in Table 1.

TABLE 1

| | DISTANCE BETWEEN FIRST HEAD AND PLATEN | DISTANCE BETWEEN SECOND HEAD AND PLATEN | DISCHARGE RELIABILITY | BLEEDING OF PLASTIC FILM | BLEEDING OF FABRIC |
|---|---|---|---|---|---|
| EX1 | 4.0 mm | 4.0 mm | ACCEPTABLE | GOOD | GOOD |
| EX2 | 4.5 mm | 4.5 mm | GOOD | GOOD | GOOD |
| EX3 | 5.0 mm | 4.5 mm | EXCELLENT | GOOD | GOOD |
| CE1 | 2.0 mm | 2.0 mm | POOR | GOOD | GOOD |
| CE2 | 3.0 mm | 3.0 mm | GOOD | POOR | POOR |

As illustrated in Comparative Example 2, the liquid discharge apparatus 100 did not include the heater 40, and the color ink was applied on the recording medium 30 before the pretreatment liquid was dried. Thus, the fabric bleeding occurred.

In Comparative Example 1, the liquid discharge apparatus 100 includes the heater 40 so that the above-described problem was prevented. However, nozzles were clogged that reduces the discharge reliability since the pretreatment liquid was easily dried as described above.

Conversely, the liquid discharge apparatus 100 in Example 1 includes the first head 11 and the platen 15 having a distance (gap) between the first head 11 and the platen 15 larger than the distance (gap) between the first head 11 and the platen 15 in each of Comparative Examples 1 and 2. Thus, the liquid discharge apparatus 100 in Example 1 can ensure the minimum discharge reliability of the heads 11 and 12 while reduce the bleeding to the minimum.

In Examples 2 and 3, the discharge reliability is further improved as compared with Example 1. From the above-described consideration, the distance (gap) between the first head 11 and the platen 15 is preferably 4.5 mm or more. Particularly, the distance (gap) between the first head 11 and the platen 15 is more preferably 5.0 mm or more. Thus, it is further reduced a contact between the recording medium 30 and the heads 11 and 12 due to deformation called cockling (waving) of the recording medium.

Examples 4 to 6

In Examples 4 to 6, the evaluation of fabric bleeding was performed while changing the distance (gap) between the second head 12 and the platen 15 and the thickness of the recording medium 30.

In Table 2, Example 4 is referred to as EX4, Example 5 is referred to as EX5, and Example 6 is referred to as EX6.

In Examples 4 to 6, the evaluation of discharge reliability, the evaluation of bleeding of a plastic film, and the evaluation of fabric bleeding were performed in the same manner as in the described Examples 1 to 3 and Comparative Examples 1 and 2. The thickness of the recording medium 30 was changed as follows in the evaluation of the fabric bleeding.

In Example 4, the same evaluation as in Example 1 was performed except that the liquid discharge apparatus 100 according to the first embodiment was used and the thickness of the recording medium was set to 4.0 mm.

In Example 5, the same evaluation as in Example 1 was performed except that the liquid discharge apparatus 100 according to the fifth embodiment (FIG. 13) was used and the thickness of the recording medium 30 was set to 4.0 mm.

In Example 6, the same evaluation as in Example 1 was performed except that the liquid discharge apparatus 100 of the fifth embodiment (FIG. 13) was used and the thickness of the recording medium was set to 3.5 mm.

The obtained results are illustrated in Table 2.

TABLE 2

| | DISTANCE BETWEEN FIRST HEAD AND PLATEN | DISTANCE BETWEEN SECOND HEAD AND PLATEN | THICKNESS OF RECORDING MEDIUM | DISCHARGE RELIABILITY | BLEEDING OF PLASTIC FILM | BLEEDING OF FABRIC |
|---|---|---|---|---|---|---|
| EX4 | 5.0 mm | 5.0 mm | 4.0 mm | ACCEPTABLE | GOOD | GOOD |
| EX5 | 5.0 mm | 4.5 mm | 4.0 mm | ACCEPTABLE | GOOD | GOOD |
| EX6 | 5.0 mm | 4.5 mm | 3.5 mm | GOOD | GOOD | GOOD |

Even if a sufficient distance (gap) between the first head 11 and the platen 15 is provided, the distance between the first head 11 and the recording medium 30 decreases with increase of the thickness of the recording medium. In Example 6, the heat from the heater 40 is also supplied to the first head 11 from the recording medium 30 since the recording medium 30 is heated by the heater 40. Accordingly, the thickness of the recording medium 30 is preferably 3.5 mm or less. Further, the distance (gap) between the first head 11 and the surface of the recording medium 30 is preferably 1.5 mm or more.

Another problem may be occurred in which the landing position of the ink tends to shift with an increase of the distance between the second head 12 and the platen 15. The liquid discharge apparatuses 100 in Examples 3, 5, and 6 increase the distance (gap) between the first head 11 and the platen 15 while reducing the distance between the second head 12 and the platen 15 that requires a landing accuracy. The first head 11 discharges the pretreatment liquid that is easily dried. The second head 12 requires a landing accuracy to accurately discharge the ink onto a predetermined position of the recording medium 30. Thus, Examples 3, 5, and 6 can greatly reduce the bleeding.

Numerous additional modifications and variations are possible in light of the above teachings. Such modifications and variations are not to be regarded as a departure from the scope of the present disclosure and appended claims, and all such modifications are intended to be included within the scope of the present disclosure and appended claims.

What is claimed is:

1. A liquid discharge apparatus, comprising:

a head configured to discharge a pretreatment liquid from nozzles formed on a nozzle surface of the head onto a medium;

a holder configured to hold the medium with a gap between the nozzle surface of the head and the holder; and a heater configured to heat the medium held by the holder, wherein the head discharges the pretreatment liquid onto the medium held by the holder with the gap being 4.0 mm or more.

2. The liquid discharge apparatus according to claim 1, wherein the holder includes the heater.

3. The liquid discharge apparatus according to claim 1, wherein the holder includes:

a first holding area that includes the heater; and a second holding area that does not include the heater, wherein the head does not discharge the pretreatment liquid at a position facing the first holding area.

4. The liquid discharge apparatus according to claim 3, wherein the first holding area has a temperature gradient in which temperature decreases toward the second holding area.

5. The liquid discharge apparatus according to claim 3, wherein the second holding area includes:

a first area that faces the head; and a second area that does not face the head, wherein temperature at the first area is lower than temperature at the second area.

6. The liquid discharge apparatus according to claim 3, wherein the holder is configured to convey the medium, and the first holding area is disposed upstream of each of the second holding area and the head in a direction of conveyance of the medium.

7. The liquid discharge apparatus according to claim 1, further comprising:

a pressing member configured to press the medium onto a part of the holder before the head discharges the pretreatment liquid onto the medium.

8. The liquid discharge apparatus according to claim 1, wherein the pretreatment liquid contains a polyvalent metal ion.

9. The liquid discharge apparatus according to claim 1, wherein a thickness of the medium is 3.5 mm or less.

10. The liquid discharge apparatus according to claim 1, further comprising:

an exhaust configured to exhaust gas between the head and the holder, wherein the exhaust is disposed upstream of each of the holder and the head in a direction of conveyance of the medium.

11. The liquid discharge apparatus according to claim 1, further comprising:

a carriage configured to reciprocally move the head, and an exhaust mounted on the carriage on a side upstream of the head in a direction of conveyance of the medium.

12. A liquid discharge apparatus comprising:

a first head configured to discharge a pretreatment liquid from first nozzles formed on a first nozzle surface of the first head onto a medium;

a second head configured to discharge an ink from second nozzles formed on a second nozzle surface of the second head onto the medium;

a holder configured to hold the medium with a first gap between the first nozzle surface of the first head and the holder and with a second gap between the second nozzle surface of the second head and the holder; and a heater configured to heat the medium held by the holder, wherein the first gap is larger than the second gap.

13. The liquid discharge apparatus according to claim 12, wherein the first head discharges the pretreatment liquid onto the medium held by the holder with the first gap being 4.0 mm or more.

14. The liquid discharge apparatus according to claim 13, wherein the first head is disposed upstream of the second head in a direction of conveyance of the medium.

15. The liquid discharge apparatus according to claim 14, further comprising:

a shield disposed between the first head and the second head.

16. A liquid discharge apparatus, comprising:

a head configured to discharge a pretreatment liquid from nozzles formed on a nozzle surface of the head onto a medium;

a holder configured to hold the medium with a gap between the nozzle surface of the head and the holder; and a heater configured to heat the medium held by the holder, wherein the head discharges the pretreatment liquid onto the medium held by the holder with the gap being 4.0 mm or more, and wherein the holder includes a holding area that does not include the heater, and the head discharges the pretreatment liquid at a position facing the holding area.

* * * * *